US011482174B2

(12) United States Patent
Kim et al.

(10) Patent No.: US 11,482,174 B2
(45) Date of Patent: Oct. 25, 2022

(54) DISPLAY DEVICE AND DRIVING METHOD OF THE DISPLAY DEVICE

(71) Applicant: Samsung Display Co., Ltd., Yongin-Si (KR)

(72) Inventors: Yu-Chol Kim, Jeonju-si (KR); Jin-Wook Yang, Suwon-si (KR); Ji Hye Kim, Hwaseong-si (KR); Young Ha Sohn, Seongnam-si (KR); Jae-Hyeon Jeon, Seoul (KR)

(73) Assignee: Samsung Display Co., Ltd.

( * ) Notice: Subject to any disclaimer, the term of this patent is extended or adjusted under 35 U.S.C. 154(b) by 42 days.

(21) Appl. No.: 16/903,295

(22) Filed: Jun. 16, 2020

(65) Prior Publication Data

US 2021/0065619 A1 Mar. 4, 2021

(30) Foreign Application Priority Data

Aug. 28, 2019 (KR) ..... 10-2019-0105904

(51) Int. Cl.
*G09G 3/325* (2016.01)
*G09G 3/3266* (2016.01)
*G09G 3/3291* (2016.01)

(52) U.S. Cl.
CPC ..... *G09G 3/325* (2013.01); *G09G 3/3266* (2013.01); *G09G 3/3291* (2013.01); *G09G 2310/0202* (2013.01); *G09G 2310/027* (2013.01)

(58) Field of Classification Search
CPC .... G09G 3/325; G09G 3/3266; G09G 3/3291; G09G 2310/0202; G09G 2310/027
See application file for complete search history.

(56) References Cited

U.S. PATENT DOCUMENTS 8,610,648 B2 * 12/2013 Goh ..... G09G 3/3233 345/82
2005/0219196 A1 * 10/2005 Lee ..... G09G 3/3614 345/100
2011/0316892 A1 * 12/2011 Sung ..... G09G 3/3233 345/212
2012/0249615 A1 10/2012 Lee
2015/0348464 A1 * 12/2015 In ..... G09G 3/2022 345/205
2019/0139497 A1 5/2019 Chang et al.

FOREIGN PATENT DOCUMENTS

KR 10-1048919 B1 7/2011
KR 10-1162864 B1 7/2012
KR 10-2013-0046006 A 5/2013
KR 10-1596961 B1 2/2016
KR 10-1717986 B1 3/2017
KR 10-2018-0078933 A 7/2018

* cited by examiner

*Primary Examiner* — Kenneth B Lee, Jr.
(74) *Attorney, Agent, or Firm* — Innovation Counsel LLP

(57) ABSTRACT

An embodiment provides a display device including: a light emitting diode; a driving transistor configured to supply a current to the light emitting diode; a switching transistor having an input electrode connected to a data line; and a voltage transmitting capacitor disposed between an output electrode of the switching transistor and a gate electrode of the driving transistor, wherein a data voltage applied to the data line may be transmitted to the gate electrode of the driving transistor through the voltage transmitting capacitor, and the data voltage may have a data voltage value from which a voltage variation variable is removed based on leakage of the switching transistor.

19 Claims, 17 Drawing Sheets

FIG. 4

| STEP | Vth compensation | A | B | C |
|---|---|---|---|---|
| Data | - | D(n-2) | D(n-1) | D(n) |
| Node A voltage | VREF | VD(n-2) | VD(n-1) | VD(n) |
| Vg voltage change | - | K(VD(n-2)-VREF) | K(VD(n-1)-VD(n-2)) | K(VD(n)-VD(n-1)) |
| Vg | VELVDD-Vth | VELVDD-Vth+ K(VD(n-2)-VREF) | VELVDD-Vth+ K(VD(n-1)-VREF) | VELVDD-Vth+ K(VD(n)-VREF) |

FIG. 9

| Application period | A | B | C |
|---|---|---|---|
| PDC use (×)<br>PDC not use (O) | O | O | O |
| | O | O | × |
| | O | × | × |
| | × | O | × |
| | × | O | O |
| | × | × | O |
| | O | × | O |

FIG. 14

| STEP | Vth compensation | A' | B | C |
|---|---|---|---|---|
| Data change | - | VREF | D(n-1) | D(n) |
| Node A voltage | VREF | VREF | D(n-1) | D(n) |
| Vg voltage change | - | K(VREF-VREF)=0 | K(VD(n-1)-VREF) | K(VD(n)-VD(n-1)) |
| Vg | VELVDD-Vth | ELVDD-Vth | ELVDD-Vth+ K(VD(n-1)-VREF) | ELVDD-Vth+ K(VD(n)-VREF) |

DISPLAY DEVICE AND DRIVING METHOD OF THE DISPLAY DEVICE

CROSS-REFERENCE TO RELATED APPLICATION

This application claims priority to and the benefit of Korean Patent Application No. 10-2019-0105904 filed in the Korean Intellectual Property Office on Aug. 28, 2019, and the entire content of the Korean Patent Application is incorporated herein by reference.

BACKGROUND

1. Field

The technical field relates to a display device and a driving method of the display device, and more particularly, to a display device including a lookup table and a driving method of the display device.

2. Description of the Related Art

Liquid crystal display devices and aorganic light emitting diode display devices are typical flat panel displays that are widely used. Among such display devices, the organic light emitting diode display device is seeing increased use, and the organic light emitting diode display includes a light emitting diode (LED) whose luminance is controlled by a current.

In addition, a pixel of the organic light emitting diode display device may include the light emitting diode, a driving transistor controlling an amount of current supplied to the light emitting diode, and a switching transistor transmitting a data voltage to the driving transistor.

The above information in this Background section is only for enhancement of understanding of the background of the described technology, and therefore it may contain information that does not form the prior art that is already known in this country to a person of ordinary skill in the art.

SUMMARY

Embodiments have been made to provide a display device that may compensate for characteristics of a transistor included in a pixel. Embodiments have been made to provide a display device in which a Vth compensation period and a programming period are separated. Embodiments have been made to provide a display device that may display an image in which parasitic capacitance and leakage of a transistor are compensated.

An embodiment provides a display device including: a light emitting diode; a driving transistor configured to supply a current to the light emitting diode; a switching transistor having an input electrode connected to a data line; and a voltage transmitting capacitor disposed between an output electrode of the switching transistor and a gate electrode of the driving transistor, wherein a data voltage applied to the data line may be transmitted to the gate electrode of the driving transistor through the voltage transmitting capacitor, wherein the data voltage may have a data voltage value from which a voltage variation variable is removed based on leakage of the switching transistor.

The compensated data voltage may be a voltage that is compensated based on parasitic capacitance of a first electrode among two electrodes of the voltage transmitting capacitor, the first electrode connected to the gate electrode of the driving transistor.

The compensated data voltage may be compensated based on a magnitude of the data voltage before and after being applied to one data line.

Each of a plurality of pixels may include the light emitting diode, the driving transistor, the switching transistor, and the voltage transmitting capacitor, and the display device may include: a display part in which the plurality of the pixels are formed and including a scan line and a data line; a data driver connected to the data line; a scan driver connected to the scan line; and a signal controller configured to controls the data driver and the scan driver.

The signal controller may include a lookup table, and a value stored in the lookup table is stored in a location based on leakage of the switching transistor.

The plurality of pixels is configured to have an initialization period, a Vth compensation period, and a programming period, and the Vth compensation period and the programming period do not overlap.

The signal controller may further include an image data converter is configured to generate a final gray data by using a continuous gray data inputted to the programming period and the lookup table in one pixel PX.

A second electrode, which is another electrode among the two electrodes of the voltage transmitting capacitor, may be connected to the switching transistor through a first node, and the first node may configured to have a reference voltage before the switching transistor is turned on.

The compensated data voltage may be applied so that a voltage of the gate electrode of the driving transistor is VELVDD−Vth+K(VD(n)−VREF), wherein VELVDD is a voltage value of a first power supply voltage, Vth is a threshold voltage value of the driving transistor, K is [C2/(C2+Cp)], C2 is a capacitance of the voltage transmitting capacitor, Cp is a parasitic capacitance that is parasitic next to the first electrode of the voltage transmitting capacitor, VD(n) is a voltage value of D(n) that is currently applied gray data, and VREF is a reference voltage value.

An input electrode of the driving transistor may be connected to the first power supply voltage, wherein a hold capacitor is disposed between the first power supply voltage and the first node may be further included.

The display device may further include a compensation transistor having an input electrode connected to an output electrode of the driving transistor and an output electrode connected to the first node.

The display device may further include a current transmitting transistor having an output electrode connected to the light emitting diode and an input electrode connected to the output electrode of the driving transistor.

The display device may further include a gate initialization transistor configured to initialize a voltage of the gate electrode of the driving transistor, and a first node initialization transistor configured to initialize a voltage of the first node to the reference voltage.

The display device may further include an anode initialization transistor configured to initialize an anode electrode that is one electrode of the light emitting diode.

Another embodiment provides a driving method of a display device, wherein the display device includes a light emitting diode, a driving transistor, a switching transistor provided with an input electrode connected to a data line, and a first capacitor disposed between an output electrode of the switching transistor and a gate electrode of the driving transistor, including: obtaining a value of α that is a difference between an adjacent previous data voltage and a current data voltage to be applied to one data line; determining a lookup table capable of removing a voltage variation variable due to leakage of the switching transistor based on the obtained $\alpha$ value; and changing gray data corresponding to the current data voltage based on the determined lookup table to generate a final gray data.

The final gray data is compensated based on parasitic capacitance of the first electrode of the first capacitor connected to the gate electrode of the driving transistor.

The determining of the lookup table may include: determining whether a voltage is changed in a positive direction or in a negative direction or is not changed based on the value of a; and changing the lookup table except when the value of $\alpha$ is zero.

The changing of the lookup table may include: determining a correction parameter based on the value of $\alpha$; replacing the value of $\alpha$ based on the correction parameter; and converting a value replaced from the value of $\alpha$ by multiplying it by the value stored in the lookup table.

The correction parameter may be a value determined based on the value of $\alpha$ or determined based on a weight.

A voltage of the gate electrode of the driving transistor by the final gray data may be VELVDD−Vth+K(VD(n)−VREF), wherein VELVDD is a voltage value of a first driving voltage, Vth is a threshold voltage value of the driving transistor, K is [C2/(C2+Cp)], C2 is a capacitance of the voltage transmitting capacitor, Cp is a parasitic capacitance that is parasitic next to the first electrode of the voltage transmitting capacitor, VD(n) is a voltage value of D(n) which is currently applied gray data, and VREF is a voltage of a first node at which the first capacitor and the switching transistor are connected before the switching transistor is turned on.

According to the embodiments, display quality may be improved by eliminating a charging failure caused by a leakage current of a transistor. The display quality is not changed by parasitic capacitance formed in a pixel. Each pixel included in a display device may display a predetermined luminance regardless of a threshold voltage of a driving transistor. In addition, Vth compensation may be clearly and separately performed by separating a Vth compensation period and a programming period.

BRIEF DESCRIPTION OF THE DRAWINGS

FIG. 4 illustrates a table summarizing a voltage change in each programming period.

FIG. 9 shows a table illustrating whether an image data converter is operated according to various embodiments.

FIG. 14 illustrates a table summarizing a voltage change in each programming period in the embodiment of FIG. 13.

DETAILED DESCRIPTION

Figure 1:
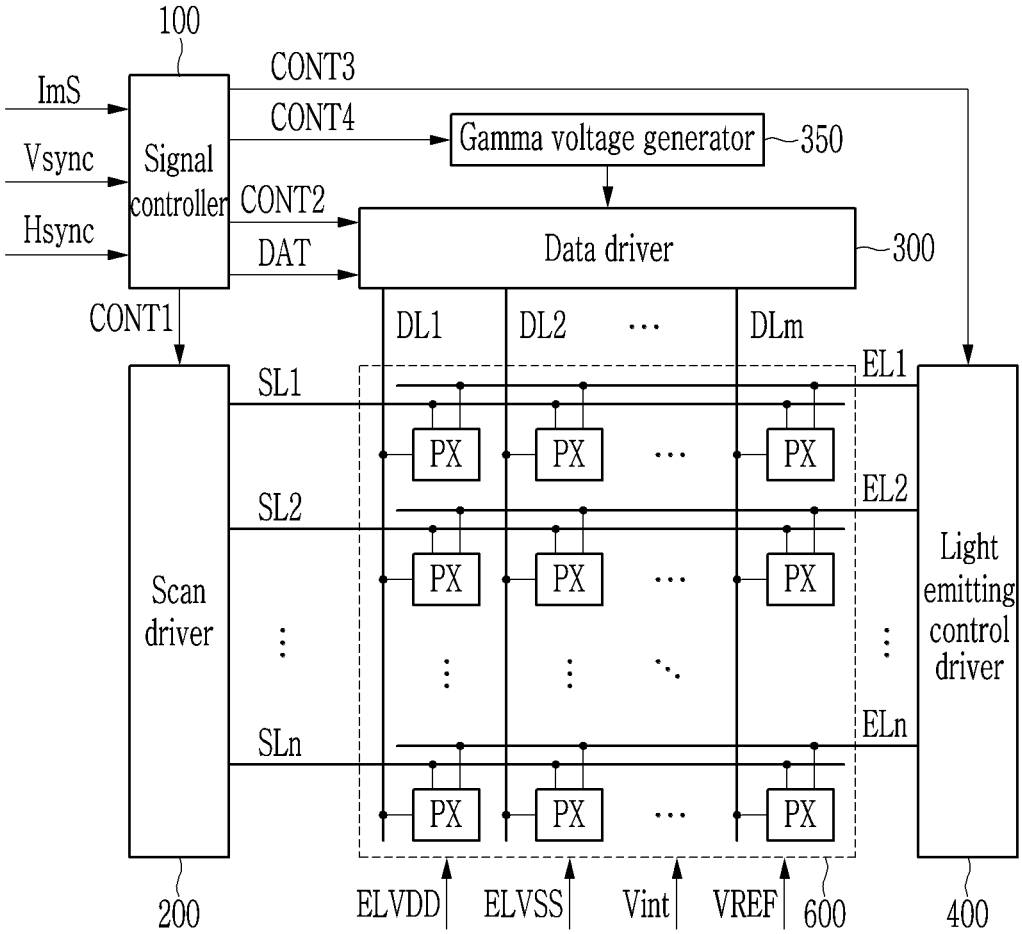
FIG. 1 illustrates a block diagram of a display device according to an embodiment.

The present inventive concept will be described more fully hereinafter with reference to the accompanying drawings, in which example embodiments of the present inventive concept are shown. As those skilled in the art would realize, the described embodiments may be modified in various different ways, all without departing from the spirit or scope of the present disclosure.

In the present disclosure, like reference numerals may designate like elements.

Further, in the drawings, the size and thickness of each element are arbitrarily illustrated for ease of description, and the present disclosure is not necessarily limited to those illustrated in the drawings. In the drawings, dimensions of elements may be exaggerated for clarity.

When a first element is referred to as being "on" a second element, the first element can be directly or indirectly on the second element. One or more intervening elements may be present between the first element and the second element. Further, in the specification, the word "on" or "above" means positioned on or below the object portion, and does not necessarily mean positioned on the upper side of the object portion based on a gravitational direction.

In the present specification, unless explicitly described to the contrary, the word "comprise" and variations such as "comprises" or "comprising" may imply the inclusion of stated elements but may not require the exclusion of any other elements. Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

Each of the elements described, such as "controller," "driver," "generator," and so on, may be hardware or software. For example, these elements may be circuits, microcontrollers, processors, RAM memory, and other such electronic devices.

Furthermore, throughout this specification and the claims that follow, when it is described that an element is "coupled" to another element, the element may be "coupled" to the other element or "electrically coupled" to the other element through a third element.

Hereinafter, a display device according to an embodiment will be described with reference to FIG. 1.

FIG. 1 illustrates a block diagram of a display device according to an embodiment.

Referring to FIG. 1, the display device includes a signal controller 100, a scan driver 200, a data driver 300, a gamma voltage generator 350, a light emitting control driver 400, and a display part 600.

An image signal ImS input from the outside of the display device and an input control signal are input to the signal controller 100. The image signal ImS includes luminance information of each pixel PX, where the luminance information includes a predetermined number of gray levels. The input control signal may include a vertical synchronization signal Vsync and a horizontal synchronization signal Hsync. The input control signal may be for displaying an image based on the image signal ImS.

The signal controller 100 receiving the image signal ImS and the input control signal from the outside may divide the image signal ImS into units of frames according to the vertical synchronization signal Vsync, and it may divide the image signal ImS into units of scan lines SL1-SLn according to the horizontal synchronization signal Hsync. The signal controller 100 may generate an image data signal DAT, a scan control signal CONT1, a data control signal CONT2, a light emitting control signal CONT3, and a gamma voltage control signal CONT4 based on the image signal ImS and the input control signal.

The signal controller 100 transmits the scan control signal CONT1 to the scan driver 200, the data control signal CONT2 and the image data signal DAT to the data driver 300, the light emitting control signal CONT3 to the light emitting control driver 400, and the gamma voltage control signal CONT4 to the gamma voltage generator 350. The signal controller 100 may further include a lookup table LUT (see FIG. 5).

The signal controller 100 uses the lookup table when converting the image signal ImS into the image data signal DAT. The lookup table may be stored in a storage device such as a memory.

The signal controller 100 separates the received image signal ImS into gray data corresponding to each pixel PX and converts the image signal ImS into final gray data through the lookup table LUT. The final gray data may then be bundled into an image data signal DAT that may be transmitted to the data driver 300.

The final gray scale data has a gray data value that allows the pixel PX to actually display the luminance to be displayed by the pixel PX in the image signal ImS.

The lookup table may include a plurality of lookup tables, and includes a lookup table (hereinafter referred to as a lookup table for threshold voltage compensation) for compensating characteristics of the driving transistor (T1 of FIG. 2) included in the pixel PX. Because the driving transistor T1 may have a different threshold voltage for each pixel, the lookup table for the threshold voltage compensation is used for compensating the characteristics of the driving transistor T1. In some embodiments, a lookup table for compensating other characteristics of each pixel may be further included.

The display part 600 includes a plurality of scan lines SL1-SLn, a plurality of data lines DL1-DLm, a plurality of light emitting control lines EL1-ELn, and a plurality of pixels PX. The plurality of pixels PX may be connected to the plurality of scan lines SL1-SLn, the plurality of data lines DL1-DLm, and the plurality of light emitting control lines EL1-ELn to be arranged in a matrix form. One pixel included in the organic light emitting diode display device may be divided with a light emitting diode LED and a pixel circuit part for driving the light emitting diode, and the pixel circuit parts may be arranged in a matrix form.

The plurality of scan lines SL1-SLn may substantially extend in a row direction and may be substantially parallel to each other. The plurality of light emitting control lines EL1-ELn may substantially extend in the row direction and may be substantially parallel to each other. The plurality of data lines DL1-DLm may substantially extend in a column direction and may be substantially parallel to each other.

The display part 600 may be supplied with a first power supply voltage ELVDD (hereinafter referred to as a driving voltage), a second power supply voltage ELVSS (hereinafter referred to as a driving low voltage), a reference voltage VREF, and an initialization voltage Vint. The first power supply voltage ELVDD may be predetermined voltage having a high level provided to an anode electrode of the light emitting diode (see LED of FIG. 2) included in each of the plurality of pixels PX. The second power supply voltage ELVSS may be a predetermined voltage having a low level provided to a cathode electrode of the light emitting diode LED included in each of the plurality of pixels PX. The first power supply voltage ELVDD and the second power supply voltage ELVSS are driving voltages transmitted to the plurality of pixels PX. The reference voltage VREF and the initialization voltage Vint may be constant voltages for initializing or resetting a specific node or element of the pixel PX to a predetermined voltage. Here, the reference voltage VREF may be a voltage at the same level as the first power supply voltage ELVDD or a voltage at a different level. In addition, the initialization voltage Vint may be a voltage having a different level from that of the second power supply voltage ELVSS.

The scan driver 200 is connected to the plurality of scan lines SL1-SLn. The scan driver 200 applies a scan signal formed of a combination of a gate-on voltage and a gate-off voltage to the plurality of scan lines SL1-SLn according to the scan control signal CONT1. The scan driver 200 may sequentially apply the scan signal having the gate-on voltage to the plurality of scan lines SL1-SLn.

The data driver 300 is connected to the plurality of data lines DL1-DLm. The data driver 300 samples and holds the image data signal DAT according to the data control signal CONT2, and applies a data voltage (see Vdat of FIG. 2) to the plurality of data lines DL1-DLm. The data driver 300 may apply the data voltage Vdat having a predetermined voltage range to the plurality data line DL1-DLm in response to the scan signal of the gate-on voltage.

The gamma voltage generator 350 provides a reference gamma voltage to the data driver 300. The gamma voltage generator 350 may adjust the level of the reference gamma voltage according to the gamma voltage control signal CONT4 and provide the reference gamma voltage to the data driver 300. The data driver 300 generates the data voltage Vdat corresponding to each gray data included in the image data signal DAT based on the reference gamma voltage. As the reference gamma voltage is adjusted, the voltage level of the data voltage Vdat may be adjusted.

The light emitting control driver 400 is connected to the plurality of light emitting control lines EL1-ELn. The light emitting control driver 400 may apply a light emitting signal (see EM signal of FIG. 3) formed by the combination of the gate-on voltage and the gate-off voltage according to the light emitting control signal CONT3 to the light emitting control lines EL1-ELn. The light emitting signal EM is applied to the plurality of pixels PX through the plurality of light emitting control lines EL1 to ELn. The light emitting control driver 400 may control a pulse width of the light emitting signal EM according to the light emitting control signal CONT3. The light emitting control driver 400 may sequentially apply the gate-off voltage and the gate-on voltage to the light emitting control lines EL1-ELn. Accordingly, the pixels PX may be sequentially turned off and on for each row.

Hereinafter, a structure and an operation of the pixel PX will be described with reference to FIG. 2 through FIG. 3.

Figure 2:
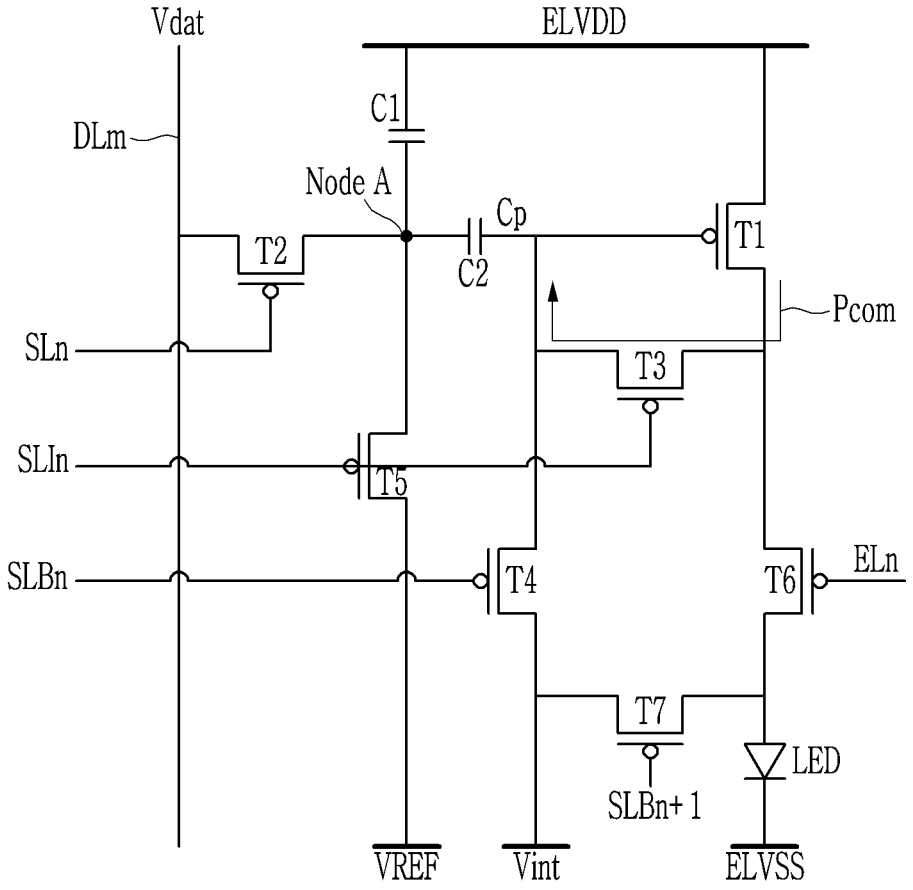
FIG. 2 illustrates an equivalent circuit diagram of one pixel of an organic light emitting diode display device according to an embodiment.
Figure 3:
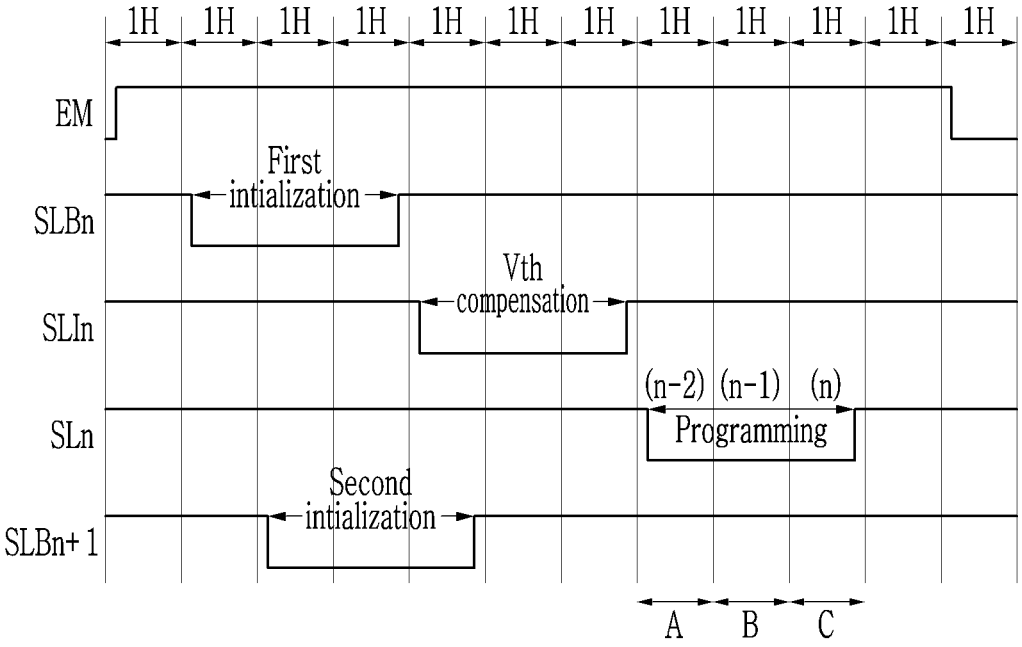
FIG. 3 illustrates a waveform diagram of a signal applied to the pixel of FIG. 2.

FIG. 2 illustrates an equivalent circuit diagram of one pixel of an organic light emitting diode display device according an embodiment, and FIG. 3 illustrates a waveform diagram of a signal applied to the pixel of FIG. 2.

The pixel PX of FIG. 2 is an example pixel PX positioned in an n-th pixel row and an m-th pixel column among the plurality of pixels PX formed in the display part 600 of the display device of FIG. 1.

Referring to FIG. 2, the pixel PX includes the light emitting diode LED and the pixel circuit part for driving the pixel LED, and the pixel circuit parts are arranged in a matrix form. The pixel circuit part may include all elements in the pixel PX except for the light emitting diode LED in FIG. 2. The pixel circuit part may include the driving transistor T1, a second transistor T2, a third transistor T3, a fourth transistor T4, a fifth transistor T5, a sixth transistor T6, a seventh transistor T7, a first capacitor C1, and a second capacitor C2. In addition, the first scan line SLn, the second scan line SLIn, the third scan line SLBn, the fourth scan line SLBn+1, the data line DLm, and the light emitting control line ELn may be connected to the pixel circuit part.

The driving transistor T1 includes a second electrode (output electrode) for outputting a current according to voltages of a gate electrode connected to the first electrode of the second capacitor C2, a first electrode (input electrode) connected to the first power supply voltage ELVDD, and the gate electrode. The second electrode of the driving transistor T1 is connected to the first electrode of the third transistor T3 and the first electrode of the sixth transistor T6. The output current of the driving transistor T1 is transmitted to the light emitting diode LED through the sixth transistor T6, allowing the light emitting diode LED to emit light. The strength of the output current determines the luminance of light emitted from the light emitting diode LED.

The second transistor T2 (hereinafter also referred to as a switching transistor) includes a gate electrode connected to the first scan line SLn, a first electrode connected to the data line DLm, and a second electrode connected to a Node A (also referred to as a first node). The second transistor T2 allows the data voltage Vdat to be inputted to the pixel PX and be stored in the second capacitor C2 according to the scan signal.

The second capacitor C2 (also referred to as a voltage transmitting capacitor) includes a first electrode connected to the gate electrode of the driving transistor T1 and a second electrode connected to the Node A. The second capacitor C2 transmit the data voltage Vdat outputted from the second transistor T2 to the gate electrode of the driving transistor T1. In the pixel PX of the present embodiment, the data voltage Vdat is transmitted through the second capacitor C2 rather than being directly transmitted to the gate electrode of the driving transistor T1. This method of indirectly transmitting the data voltage Vdat to the gate electrode of the driving transistor T1 relies on the fact that when the voltage of the second electrode of the second capacitor C2 suddenly increases, the voltage of the first electrode of the second capacitor C2 also increases. Thus, even if leakage from the second transistor T2 occurs, the voltage of the gate electrode of the driving transistor T1 does not directly leak.

Meanwhile, in FIG. 2, parasitic capacitance is denoted by parasitic capacitance Cp next to the first electrode of the second capacitor C2, and is an equivalent parasitic capacitance viewed through the first electrode in the second capacitor C2.

When the capacitance of the second capacitor C2 and the parasitic capacitance Cp are used, a voltage change of the first electrode according to a voltage change of the second electrode of the second capacitor C2 may be represented by Equation 1 below.

$$\nabla V1=\nabla V2\times[C2/(C2+Cp)] \quad \text{(Equation 1)}$$

Here, the capacitance of the second capacitor C2 is represented by C2, ∇V1 is a voltage change amount of the first electrode of the second capacitor C2, and ∇V2 is a voltage change amount of the second electrode of the second capacitor C2.

According to Equation 1, the voltage change of the first electrode of the second capacitor C2 is the same as that of the gate electrode of the driving transistor T1. Thus, when the data voltage Vdat is applied, the voltage change of the gate electrode of the driving transistor T1 may be calculated. When the parasitic capacitance Cp is not considered in Equation 1, the voltage change of the first electrode of the second capacitor C2 may be the same as that of the second electrode the second capacitor C2.

The first capacitor C1 (also referred to as a hold capacitor) is further connected to the Node A. The first electrode of the first capacitor C1 is connected to the Node A, and the second electrode of the first capacitor C1 receives the first power supply voltage ELVDD. As a result, even when a surrounding signal is changed, the voltage of the Node A may not be changed and may be held to have a constant voltage.

The third transistor T3 (also referred to as a compensation transistor) may include a gate electrode connected to the second scan line SLIn, a first electrode connected to the second electrode of the driving transistor T1, and a second electrode connected to the first electrode of the second capacitor C2. The third transistor T3 forms a compensation path Pcom for compensating the threshold voltage of the driving transistor T1 so that the threshold voltage of the driving transistor T1 is transmitted to the first electrode of the second capacitor C2 and compensated. Thus, even if the threshold voltage of the driving transistor T1 included in each pixel PX of the display part 600 is different from each other, each driving transistor T1 may output a constant output current according to the applied data voltage Vdat.

The fourth transistor T4 (hereinafter also referred to as a gate initialization transistor) includes a gate electrode connected to the third scan line SLBn, a first electrode applied with an initialization voltage Vint, and a second electrode connected to the first electrode of the second capacitor C2 (or the gate electrode of the driving transistor T1). The fourth transistor initialize the first electrode of the second capacitor C2 and the gate electrode of the driving transistor T1 with the initialization voltage Vint.

The fifth transistor T5 (hereinafter referred to as a Node A initialization transistor) includes a gate electrode connected to the second scan line SLIn, a first electrode applied with the reference voltage VREF, and a second electrode connected to the Node A. The fifth transistor change the Node A to the reference voltage VREF.

The sixth transistor T6 (also referred to as a current transmitting transistor) includes a gate electrode connected to the light emitting control line ELn, a first electrode connected to the second electrode of the driving transistor T1, and a second electrode connected to the anode electrode of the light emitting diode LED. The sixth transistor T6 transmits or blocks the output current of the driving transistor T1 to or from the light emitting diode LED.

Figure 11:
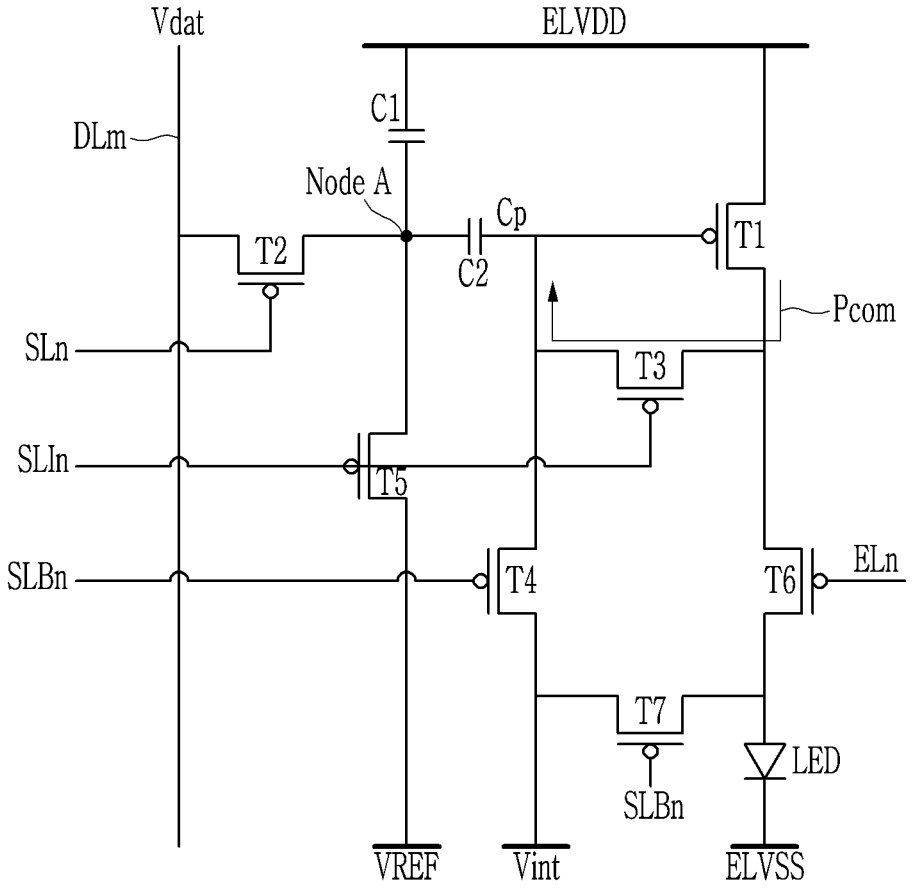
FIG. 11 illustrates an equivalent circuit diagram of one pixel of an organic light emitting diode display device according to another embodiment.

The seventh transistor T7 (also referred to as an anode initialization transistor) includes a gate electrode connected to the fourth scan line SLBn+1, a first electrode applied with an initialization voltage Vint, and a second electrode connected to the anode electrode of the light emitting diode LED. The seventh transistor T7 initializes the anode electrode of the light emitting diode LED with the initialization voltage Vint. In some embodiments, the fourth scan line SLBn+1 for operating the seventh transistor T7 and the third scan line SLBn for operating the fourth transistor T4 may be the same scan line. This embodiment is shown in FIG. 11.

In the embodiment of FIG. 2, since all the transistors are formed as p-type transistors, they are turned on when a high voltage is applied and turned off when a low voltage is applied. In other words, the gate-on voltage is a low level voltage, and the gate-off voltage is a high level voltage.

The light emitting diode LED includes an anode electrode connected to the second electrode of the sixth transistor T6 and a cathode electrode connected to the second power supply voltage ELVSS. The light emitting diode LED may be connected between the pixel circuit part and the second power supply voltage ELVSS to emit light at a luminance corresponding to a current supplied from the pixel circuit part, specifically, the driving transistor T1. The light emitting diode LED may include a light emitting layer including at least one of an organic light emitting material and an inorganic light emitting material. Holes and electrons are injected into the light emitting layer from the anode and cathode electrodes, respectively, and light is emitted when excitons in which the injected holes and electrons are combined enter a ground state from an excited state. The light emitting diode LED may emit light of one of the primary colors or white light. Examples of the primary colors may include red, green, and blue. Another example of the primary colors may include yellow, cyan, and magenta. In some embodiments, an additional color filter or a color conversion layer may be further included to improve color display characteristics.

Hereinafter, an operation of the pixel PX of FIG. 2 will be described with reference to FIG. 3.

The signal applied to the pixel PX largely includes an initialization period (Initial), a Vth compensation period, a programming period (Programming), and a light emitting period (Emission).

In FIG. 3, 1H represents one horizontal period, and one horizontal period may correspond to one horizontal sync signal Hsync. 1H may mean a time when the gate-on voltage is applied to a scan line of a next row after the gate-on voltage is applied to one scan line.

First, the light emitting period is a period in which the light emitting diode LED emits light, wherein a current output from the driving transistor T1 is transmitted to the light emitting diode LED through the sixth transistor T6. In this period, since the sixth transistor T6 is turned on, the gate-on voltage (low level voltage) is applied as the light emitting signal EM. In FIG. 3, the light emitting period in which the light emitting signal EM is applied as the gate-on voltage is briefly shown. This is because the pixel PX performs only the simple operation described above, since the gate-off voltage (high level voltage) is constantly applied to respective scan lines (the first scan line SLn, the second scan line SLIn, the third scan line SLBn, and the fourth scan line SLBn+1).

The light emitting period ends as the light emitting signal EM is changed to the gate-off voltage. A period in which the gate-off voltage of the light emitting signal EM is applied may be a total of 2H larger than a sum of the periods to which the gate-on voltage is applied in the initialization period, the Vth compensation period, and the programming period. That is, when 1H elapses after the light emitting signal EM is changed to the gate-off voltage, the initialization period starts, and when about 1H elapses after the programming period ends, the light emitting signal EM may be changed to the gate-on voltage. A size of the light emitting period may vary.

After the light emitting period ends, the first initialization period begins as the gate-on voltage is applied to the third scan line SLBn. In the first initialization period, the voltage of the gate electrode of the driving transistor T1 is changed to the initialization voltage Vint. The fourth transistor T4 is turned on to transmit the initialization voltage Vint to the gate electrode of the driving transistor T1. In this case, the first electrode of the second capacitor C2 and the second electrode of the third transistor T3 are also changed to the initialization voltage Vint.

In the embodiment, the gate-on voltage among the scan signals applied to the first scan line SLBn is applied over a period of 3H. In the scan signal applied to the third scan line SLBn, a time during which the gate-on voltage is applied may be changed.

Thereafter, as the gate-on voltage is applied to the fourth scan line SLBn+1, the second initialization period starts. In the second initialization period, the voltage of the anode electrode of the light emitting diode LED is changed to the initialization voltage Vint. For this purpose, the seventh transistor T7 is turned on to transmit the initialization voltage Vint to the anode electrode of the light emitting diode LED. In this case, the second electrode of the sixth transistor T6 is also changed to the initialization voltage Vint.

In the embodiment, the gate-on voltage among the scan signals applied to the fourth scan line SLBn+1 is applied over a period of 3H. In addition, the first initialization period and the second initialization period are separated from each other by 1H. In some embodiments, the two initialization periods may be the same. In addition, in the scan signal applied to the fourth scan line SLBn+1, a time during which the gate-on voltage is applied may be changed.

During the 2H period in which the first initialization period and the second initialization period overlap, the gate electrode of the driving transistor T1 and the anode electrode of the light emitting diode LED are simultaneously initialized.

Thereafter, while the gate-on voltage is applied to the second scan line SLIn, the Vth compensation period, that is, the threshold voltage compensation period, starts. In the Vth compensation period, the driving transistor T1 outputs a current, but the current is passed through the third transistor T3 to the second capacitor C2. As time elapses, the output of the driving transistor T1 gradually decreases, and when a voltage difference between the gate electrode and the first electrode of the driving transistor T1 is the threshold voltage Vth of the driving transistor T1, the driving transistor T1 does not output a current. As a result, the voltage of the gate electrode of the driving transistor T1 has the same value as VELVDD−Vth. Here, VELVDD is a voltage value of the first power supply voltage ELVDD. In this case, the output of the driving transistor T1 is not transmitted to the light emitting diode (LED) because the sixth transistor T6 is turned off.

In order to cause the driving transistor T1 to output a current in the Vth compensation period, the fifth transistor T5 is turned on and the voltage of the second electrode of the second capacitor C2 is changed to the reference voltage VREF. In this case, the voltage of the first electrode of the second capacitor C2 is also changed, which is because the voltage of the gate electrode of the driving transistor T1 is varied so that the driving transistor T1 generates an output current.

In this case, since the third transistor T3 is also turned on, the output current of the driving transistor T1 is transmitted to the first electrode of the second capacitor C2, and the voltage of the first electrode of the second capacitor C2 has the same value as VELVDD−Vth.

In the embodiment of FIG. 3, the gate-on voltage among the scan signals applied to the second scan line SLIn is applied over a period of 3H. In addition, in the scan signal applied to the second scan line SLIn, a time during which the gate-on voltage is applied may be changed according to embodiments.

Meanwhile, in the embodiment of FIG. 3, the period in which the gate-on voltage is applied to the second scan line SLIn and the second initialization period overlap by 1H. In this case, the driving transistor T1 outputs a current so that the voltage of the first electrode of the second capacitor C2 is changed to the voltage value of VELVDD−Vth, while the voltage of the anode electrode of the light emitting diode LED is also changed to the initialization voltage Vint.

In the present embodiment, the Vth compensation period and the first initialization period do not overlap. This is because both periods are periods for changing the voltage of the first electrode of the second capacitor C2. However, since the Vth compensation period continues after the first initialization period ends, even if some periods overlap each other, some periods may overlap each other after the Vth compensation is completed. In addition, in embodiments, the Vth compensation period and the first initialization period may be separated by 1H or more.

After the Vth compensation period, the programming period starts while the gate-on voltage is applied to the first scan line SLn. In the programming period, the data voltage Vdat is transmitted to the gate electrode of the driving transistor T1. For this purpose, the second transistor T2 is turned on to transmit the data voltage Vdat to the Node A, while the voltage of the gate electrode of the driving transistor T1 is also changed according to Equation 1, and these voltages are respectively stored in the first electrode and the second electrode of the second capacitor C2.

In addition, the Vth compensation period and the programming period are separated from each other. The compensation of the threshold voltage may be performed more clearly than if the Vth compensation period and the programming period were performed at the same time. Thus, the display quality degradation due to a difference between the threshold voltages of respective driving transistors T1 is prevented. In other words, the Vth compensation period and the programming period do not overlap.

In the embodiment of FIG. 3, the gate-on voltage among the scan signals applied to the first scan line SLn is applied over 3H. In the scan signal applied to the first scan line SLn, a time during which the gate-on voltage is applied may be changed.

In FIG. 3, the programming period is applied for a total period of 3H, which is divided into A, B, and C periods, wherein the C period is shown as an (n)-th H, the B period is shown as an (n−1)-th H, and the A period is shown as an (n−2)-th H.

Hereinafter, a change in the voltage Vg of the gate electrode of the driving transistor T1 according to a plurality of data voltages inputted to respective programming periods (A period, B period, and C period) will be described with reference to FIG. 4 together with FIG. 3.

FIG. 4 illustrates a table summarizing a voltage change in each programming period.

In FIG. 4, the voltage Vg of the gate electrode of the driving transistor T1 will be described while considering the parasitic capacitance Cp at the first electrode side of the second capacitor C2.

Hereinafter, the voltage Vg of the gate electrode of the driving transistor T1 is simply referred to as a gate voltage Vg.

Before describing respective programming periods, it may be necessary to check the voltage of the Node A and the gate voltage Vg after passing through the Vth compensation period positioned before the respective programming periods. As described above and illustrated in FIG. 4, the voltage of the Node A has the reference voltage VREF, and the gate voltage Vg has a value of VELVDD−Vth in which the threshold voltage of the driving transistor T1 is compensated.

Based on this, the change of the voltage according to the programming period will be described.

First, in the A programming period, the data voltage Vdat is transmitted to the Node A while the gate-on voltage is applied to the first scan line SLn in a state in which the voltage of the Node A is the reference voltage VREF. As a result, the voltage of the Node A is changed to the data voltage Vdat applied to the data line DLm in the A programming period.

The gray data applied during the programming period A is referred to as 'D(n−2)', the voltage of the gray data D(n−2) is referred to as VD(n−2), and K is a capacitance ratio of Equation 1, that is, C2/(C2+Cp), corresponding to respective voltages described in the programming period A of FIG. 4.

That is, since the gray data corresponding to the A programming period is D(n−2), the data voltage Vdat applied along the data line DLm is VD(n−2).

Since the voltage of the Node A is changed from VREF to VD(n−2) as the Vth compensation period is changed to the A programming period, the voltage change (∇V1) of the first electrode of the second capacitor C2 also becomes (VD(n−2)−VREF)×[C2/(C2+Cp)] in accordance with Equation 1.

Here, since [C2/(C2+Cp)] is set to K, the voltage change (∇V1) of the first electrode of the second capacitor C2 is K(VD(n−2)−VREF). Since the voltage of the first electrode of the second capacitor C2 is equal to the gate voltage Vg, a change value of the Vg voltage of Table 4 becomes K(VD(n−2)−VREF).

Since the change value of the gate voltage Vg is known when entering the A programming period, when the change value is added to the gate voltage Vg in the Vth compensation period, the gate voltage Vg in the A programming period is known. Since the gate voltage Vg in the Vth compensation period is VELVDD−Vth and the change value of the gate voltage Vg in the A programming period is K(VD(n−2)−VREF), the gate voltage Vg in the A programming period becomes VELVDD−Vth+K(VD(n−2)−VREF) as described in FIG. 4.

The B programming period will now be described based on the voltage of the A programming period as described above.

While the gate-on voltage is continuously applied to the first scan line SLn in a state in which the voltage of the Node A is VD(n−2), the data voltage Vdat of the B programming period is transmitted to the Node A. As a result, the voltage of the Node A is changed to the data voltage Vdat applied to the data line DLm in the B programming period.

The gray data applied during the B programming period is referred to as D(n−1) and the voltage of the gray data D(n−1) is referred to as VD(n−1), corresponding to each voltage described for the B programming period in FIG. 4.

That is, since the gray data corresponding to the B programming period is D(n−1), the data voltage Vdat applied along the data line DLm is VD(n−1).

Since the voltage of the Node A is changed from VD(n−2) to VD(n−1) as the A programming period is changed to the B programming period, the voltage change (∇V1) of the first electrode of the second capacitor C2 also becomes (VD(n−1)−VD(n−2))×[C2/(C2+Cp)] in accordance with Equation 1.

Here, since [C2/(C2+Cp)] is set to K, the voltage change (∇V1) of the first electrode of the second capacitor C2 is K(VD(n−1)−VD(n−2)). Since the voltage of the first electrode of the second capacitor C2 is equal to the gate voltage Vg, a change value of the Vg voltage of Table 4 becomes K(VD(n−1)−VD(n−2)).

Since the change value of the gate voltage Vg is known upon entering the B programming period, when the change value is added to the gate voltage Vg in the A programming period, the gate voltage Vg in the B programming period is known. Therefore, since the gate voltage Vg in the A programming period is VELVDD−Vth+K(VD(n−2)−VREF) and the change value of the gate voltage Vg in the B programming period is K(VD(n−1)−VD(n−2)), the gate voltage Vg in the B programming period is VELVDD−Vth+K(VD(n−2)−VREF)+K(VD(n−1)−VD(n−2)), and when grouped by K, a portion for VD(n−2) is removed, resulting in VELVDD−Vth+K(VD(n−1)−VREF).

In the same manner, the gate voltage Vg of the C programming period may also be obtained based on the voltage of the B programming period.

That is, when the gray data applied during the C programming period is referred to as D(n) and the voltage of the gray data D(n) is referred to as VD(n), the gate voltage Vg in the C programming period shown in FIG. 4 is VELVDD−Vth+K(VD(n)−VREF). This is because when grouping with K while calculating a value for the gate voltage Vg, the portion of the voltage value VD(n−1) applied to the existing data line is eliminated.

Since the K value included in the above gate voltage Vg includes the parasitic capacitance Cp at the first electrode side of the second capacitor C2, the K value is calculated based on the parasitic capacitance.

However, in an actual pixel PX, when there is a leakage in the second transistor T2, which is a switching transistor that receives the data voltage Vdat and transmits it to the second electrode side of the second capacitor C2, the actual gate voltage may be slightly different from the calculated gate voltage Vg.

That is, in an ideal and theoretical case, the gate voltage Vg value shown in FIG. 4 is obtained, because when grouping with K, the portion of the data voltage applied previously is removed.

However, in an empirical case, in the portion applied to the existing data voltage, a voltage leak occurs for 1H. In consideration of this, the value of the gate voltage Vg of each period may be changed and expressed as shown in the following table.

TABLE 1

| | |
|---|---|
| Vg of A programming period | VELVDD−Vth+K(VD(n−2)−VREF)±X1 |

TABLE 1-continued

| | |
|---|---|
| Vg of B programming period | VELVDD−Vth+K(VD(n−1)−VREF)±X2 |
| Vg of C programming period | VELVDD−Vth+K(VD(n)−VREF)±X3 |

Here, X1, X2, and X3 represent voltage variation variables generated in respective programming periods due to leakage of the second transistor T2. In embodiments, the three voltage variation variables may be the same or different, the voltage variation variable may vary according to the data voltage Vdat and the voltage stored in the second capacitor C2, and it may also be necessary to add or subtract the voltage variation variable.

In consideration of this, the voltage variation variable X2 may be a concept including the voltage variation variable X1, and the voltage variation variable X3 may be a concept including the voltage variation variables X2 and X1. However, depending on the size and direction of the data voltage Vdat and the voltage stored in the second capacitor C2, the value of the voltage variation variable may increase or decrease as the programming period passes.

If the voltage variation variable due to such leakage were not eliminated, the gate voltage Vg may improperly have a higher voltage or a lower voltage than desired, so that the luminance displayed by the light emitting diode LED is different for different pixels.

Figure 5:
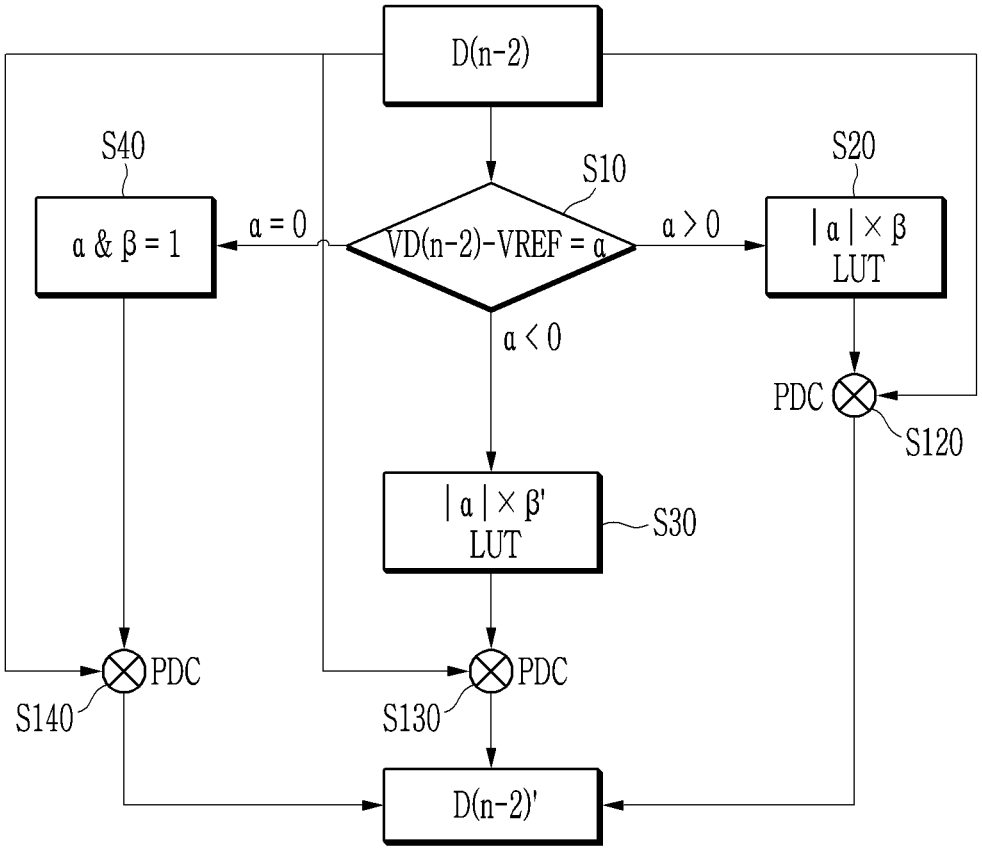
FIG. 5, FIG. 6, and FIG. 7 are drawings illustrating a process of converting image data in each programming period.
Figure 6:
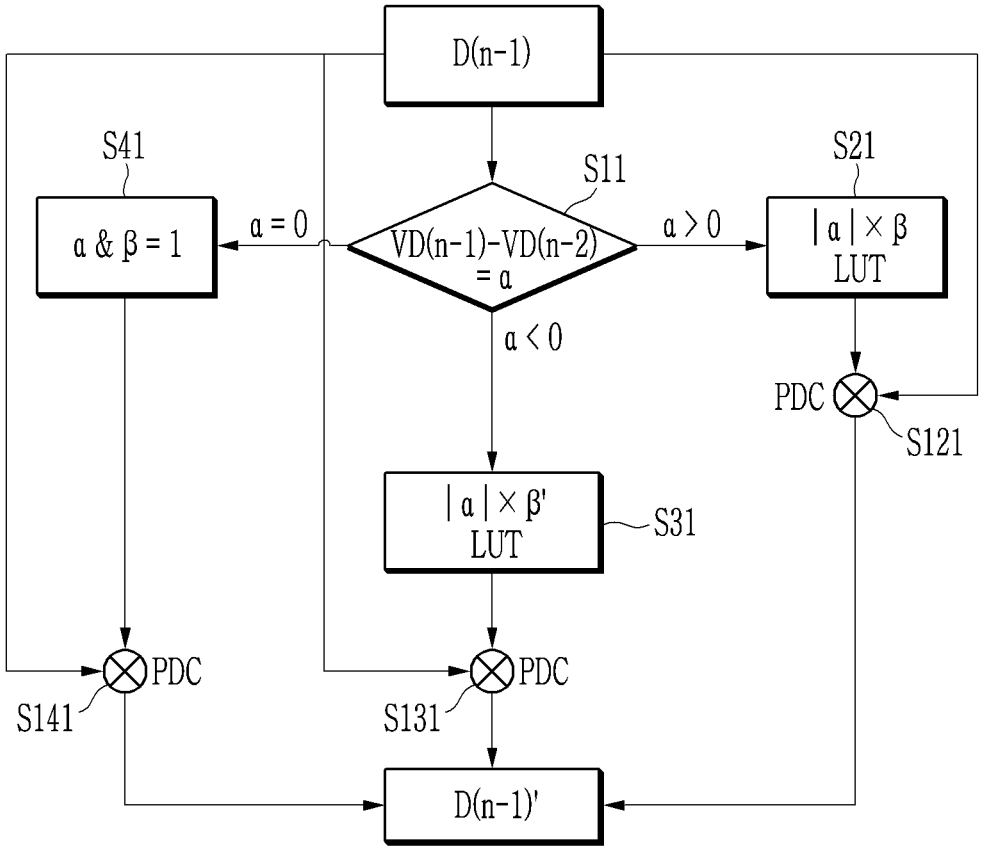
Figure 7:
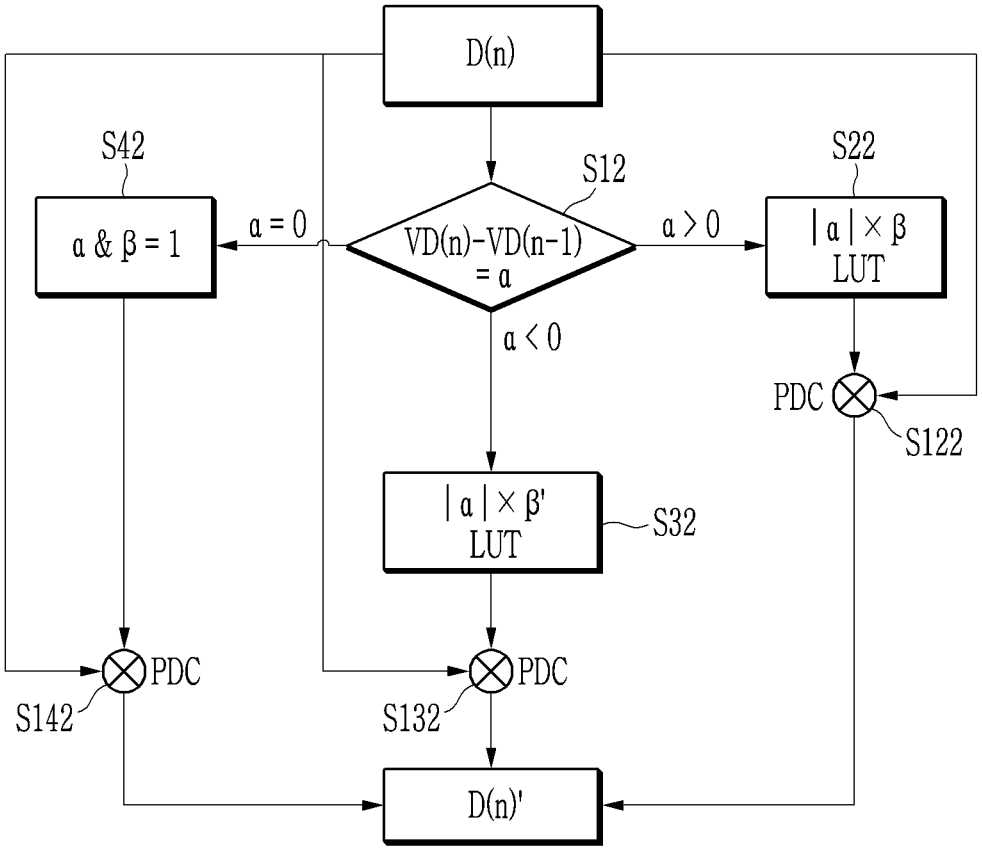

Accordingly, it is desirable eliminate the voltage variation variable based on the leakage of the second transistor T2 (e.g., based on the susceptibility to leakage of the second transistor T2), and the voltage variation variable may be eliminated by using a lookup table LUT as shown in FIG. 5 to FIG. 7.

Hereinafter, an embodiment of eliminating a voltage variation variable by converting a lookup table stored as in the lookup table for threshold voltage compensation will be described.

FIG. 5 to FIG. 7 are drawings illustrating a process of converting image data in each programming period.

FIG. 5 to FIG. 7 are drawings illustrating an order of compensating with the lookup table LUT in consideration of the leakage of the second transistor T2 as well as the parasitic capacitance Cp at the first electrode side of the second capacitor C2.

First, an order of eliminating the voltage variation variable X1 in the programming period A will be described with reference to FIG. 5.

In FIG. 5, the gray data applied during the A programming period is referred to as D(n−2), and the final gray data compensated based on the lookup table LUT is referred to as D(n−2)'. In addition, FIG. 5 illustrates a flowchart of operations of the signal controller 100 (referring also to FIG. 8 including an image data converter 110 in the signal controller 100).

When the image signal ImS is transmitted from the outside to the signal controller 100, the image signal ImS is separated into gray data corresponding to each pixel PX.

The gray data separated in this manner may be rearranged in a process of being applied to one data line DL1-DLm based on the connection structure of the pixel PX and the data lines DL1-DLm of the display part 600.

Three consecutive gray data of the rearranged gray scale data are applied to one pixel PX as D(n−2), D(n−1), and D(n) during the A, B, and C programming periods.

Among them, the gray data corresponding to the A programming period of FIG. 5 is D(n−2).

In the signal controller 100, when D(n−2) is determined from the image signal ImS, the D(n−2) is transmitted to the image data converter 110 (see FIG. 8) to generate the final gray data D(n−2)' in the order as shown in FIG. 5.

A value of α is obtained by comparing VD(n−2), which is the voltage value of the transmitted gray data D(n−2), with the voltage value VREF of the Node A (S10). The value of α, it is determines whether the voltage is changed in a positive direction, in a negative direction, or whether there is no change.

The final gray data D(n−2)' may be generated by modifying the lookup table LUT or using a separate lookup table LUT, except when the value of α is 0.

In FIG. 5, when the value of α is greater than 0, the lookup table LUT is converted (S20), and the gray data D(n−2) is converted based on the converted lookup table (S120). In this way the final gray data D(n−2)' is generated.

A method of converting the lookup table LUT uses a β value in addition to the already obtained a value. The β value is determined according to the α value and is a correction parameter, and adjusts a degree of correction of the lookup table LUT according to a size of the α value. Various β values according to the α value may be stored in a memory of the display device. The β value may be stored based on a weight or by considering all gray data values of each pixel PX into which gray data is inputted.

When the α value and the β value are determined as described above, the α value is replaced with α' by a predetermined correction parameter β, and the replacement with α' may be performed according to Equation 2.

$$\alpha'=\alpha\times\beta \quad \text{(Equation 2)}$$

The replaced α' value is used to convert the lookup table LUT by multiplying the value provided by the lookup table by the α' value.

At step S20 of FIG. 5, the conversion is represented by |α|×β LUT, and since |α|×β is the α' value, the conversion may be simplified as α'×LUT. Since α of |α| may be a negative value, the absolute value symbol is collectively used, and when α is positive, |α| is the same as the α value. The LUT in FIG. 5 means, specifically, a value provided from the lookup table LUT.

Based on the data of the converted lookup table as described above, the gray data D(n−2) is converted at step S120 to generate the final gray data D(n−2)'.

In the above description, the value of α' is a value changed so that the corrected final gray data D(n−2)' cancels a voltage variation variable of ±X1 in Table 1. As a result, the gate voltage Vg at a time of entering the B programming period is equal to the voltage (VELVDD−Vth+K(VD(n−2)−VREF)) denoted in FIG. 4.

In FIG. 5 and the following drawings, as described above, generating the final gray data by using continuous gray data inputted to a corresponding programming period in one pixel PX and the lookup table LUT is simply referred to as PDC. The PDC is an abbreviation of 'Previous Data coupling Compensation', which means that current gray data is corrected by using a previous gray data. Here, the previous gray data and the current gray data are named based on data programmed (or written) in one pixel PX. Hereinafter, the previous gray data is converted to the data voltage is referred to as a previous data voltage, and the current gray data is converted to the data voltage is referred to as a current data voltage.

Hereinafter, a case in which a is smaller than 0 in FIG. 5 will be described.

When the α value is smaller than 0, since the β value used when the α value is larger than 0 may not be used, the lookup table LUT is converted using the β' value, which is another correction parameter (S30). The gray data D(n−2) is converted based on the converted lookup table at step S130 to generate final gray data D(n−2)'.

The β' value is a correction parameter is determined according to the α value, and adjusts a degree of correction of the lookup table LUT according to a size of the α value. Various β' values according to the α value may be stored in a memory of the display device. The β' value may be stored based on a weight or by considering all gray data values of each pixel PX into which gray data is inputted.

When the α value and the β' value are determined as described above, the α value is replaced with α" by a predetermined correction parameter β', and the replacement with α" may be performed according to Equation 3.

$$\alpha''=|\alpha|\times\beta' \quad \text{(Equation 3)}$$

The replaced α" value is used to convert the lookup table LUT by multiplying the value provided by the lookup table by the α" value.

At step S30 of FIG. 5, the conversion is represented by |α|×β' LUT, which may be simplified as α"×LUT. Since α of |α| may be a negative value, the absolute value symbol is used, and when α is negative, |α| is the same as the −α value.

Based on the data of the converted lookup table as described above, the gray data D(n−2) is converted at step S130 to generate the final gray data D(n−2)'.

In the above description, the value of α" is a value that is changed so that the corrected final gray data D(n−2)' cancels a voltage variation variable of ±X1 in Table 1. As a result, the gate voltage Vg at a time of entering the B programming period is equal to the voltage (VELVDD−Vth+K(VD(n−2)−VREF)) denoted in FIG. 4.

FIG. 5 also shows a case in which the value of α is zero. In this case, the α value is converted to 1 and the β value is also used as 1 at step S40 so that the existing lookup table LUT is not changed. That is, even when the value of α and the value of β are multiplied there is no change even when the multiplied value of 1 and the value provided from the look-up table LUT are multiplied. That is, the final gray data D(n−2)' is generated by using the original lookup table LUT.

In other words, when the value of α is 0 in FIG. 5, the value of α is converted to 1 and the value of β is also used as 1 at step S40, so that the lookup table LUT is not converted. Since the gray data D(n−2) is converted based on the unconverted lookup table (S140), the final gray data D(n−2)' may be substantially the same as the original gray data D(n−2).

Although it is described in FIG. 5 that the lookup table is not changed only when the value of α is 0, in embodiments, the lookup table may not be changed when the value of α is less than or equal to a predetermined level (for example, −1 or more to 1 or less).

Hereinafter, an operation of being converted into the final gray data D(n−1)' in the B programming period will be described with reference to FIG. 6.

When the gray data corresponding to FIG. 6 and the B programming period is D(n−1) and when D(n−1) is determined from the image signal ImS by the signal controller 100, D(n−1) is transmitted to the image data converter 110 (see FIG. 8) to generate final gray data D(n−1)' in a process as shown in FIG. 6.

A value of α is obtained by comparing VD(n−1), which is the voltage value of the transmitted gray data D(n−1), with the voltage value VREF of the Node A (S11). The value of α determines whether the voltage is changed in a positive direction, in a negative direction, or whether there is no change.

The final gray data D(n−1)' may be generated by modifying the lookup table LUT or using a separate lookup table LUT, except when the value of α is 0.

When the value of α is greater than 0, the lookup table LUT is converted (S21), the gray data D(n−1) is converted based on the converted lookup table (S121), and thus the final gray data D(n−1)' is generated.

A method of converting the lookup table LUT uses a β value in addition to the already obtained a value. The β value is determined according to the α value and is a correction parameter, and adjusts a degree of correction of the lookup table LUT according to a size of the α value. Various β values according to the α value may be stored in a memory of the display device. The β value may be stored based on a weight or by considering all gray data values of each pixel PX into which gray data is inputted.

When the α value and the β value are determined as described above, the α value is replaced with α' by a predetermined correction parameter β, and the replacement with α' may be performed according to Equation 2.

The replaced α' value is used to convert the lookup table LUT by multiplying the value provided by the lookup table by the α' value.

Based on the data of the converted lookup table as described above, the gray data D(n−1) is converted at step S121 to generate the final gray data D(n−1)'.

In the above description, the value of α' is a value changed so that the corrected final gray data D(n−1)' cancels a voltage variation variable of ±X2 in Table 1. As a result, the gate voltage Vg at a time of entering the C programming period is equal to the voltage (VELVDD−Vth+K(VD(n−1)−VREF)) denoted in FIG. 4.

Hereinafter, a case in which α is smaller than 0 in FIG. 6 will be described.

When the α value is smaller than 0, since the β value used when the α value is larger than 0 may not be used, the lookup table LUT is converted by using the β' value, which is another correction parameter (S31). The gray data D(n−1) is converted based on the converted lookup table at step S131 to generate final gray data D(n−1)'.

The β' value is determined according to the α value and is a correction parameter, and adjusts a degree of correction of the lookup table LUT according to a size of the α value, and various β' values according to the α value may be stored in a memory of the display device. The β' value may be stored based on a weight or by considering all gray data values of each pixel PX into which gray data is inputted.

When the α value and the β' value are determined as described above, the α value is replaced with α" by a predetermined correction parameter β', and the replacement with α" may be performed according to Equation 3.

The replaced α" value is used to convert the lookup table LUT by multiplying the value provided by the lookup table by the α" value.

Based on the data of the converted lookup table as described above, the gray data D(n−1) is converted at step S131 to generate the final gray data D(n−1)'.

In the above description, the value of α" is a value changed so that the corrected final gray data D(n−1)' cancels a voltage variation variable of ±X2 in Table 1. As a result, the gate voltage Vg at a time of entering the C programming period is equal to the voltage (VELVDD−Vth+K(VD(n−1)−VREF)) denoted in FIG. 4.

FIG. 6 also shows a case in which the value of α is zero. In this case, the α value is converted to 1 and the β value is also used as 1 at step S41 so that the existing lookup table LUT is not changed. That is, when the value of α is 0 in FIG. 6, the value of α is converted to 1 and the value of β is also used as 1 at step S41, so that the lookup table LUT is not converted. Since the gray data D(n−1) is converted based on the unconverted lookup table (S141), the final gray data D(n−1)' may be substantially the same as the original gray data D(n−1).

Although FIG. 6 illustrates that the lookup table is not changed only when the value of α is 0, in embodiments, the lookup table may not be changed when the value of α is less than or equal to a predetermined level (for example, −1 or more to 1 or less).

Hereinafter, an operation of being converted into the final gray data D(n)' in the C programming period will be described with reference to FIG. 7.

When the gray data corresponding to FIG. 7 and the C programming period is D(n) and when D(n) is determined from the image signal ImS by the signal controller 100, D(n) is transmitted to the image data converter 110 (see FIG. 8) to generate final gray data D(n)' in a process as shown in FIG. 7.

A value of α is obtained by comparing VD(n), which is the voltage value of the transmitted gray data D(n), with the voltage value VD(n−1) of the Node A (S12). The value of α determines whether the voltage is changed in a positive direction, in a negative direction, or whether there is no change.

The final gray data D(n−1)' may be generated by modifying the lookup table LUT or using a separate lookup table LUT, except when the value of α is 0.

In FIG. 7, when the value of α is greater than 0, the lookup table LUT is converted (S22), and the gray data D(n) is converted based on the converted lookup table (S122), thus the final gray data D(n)' is generated.

A method of converting the lookup table LUT uses a β value in addition to the already obtained α value. The β value is determined according to the α value and is a correction parameter, and adjusts a degree of correction of the lookup table LUT according to a size of the α value. Various β values according to the α value may be stored in a memory of the display device. The β value may be stored based on a weight or by considering all gray data values of each pixel PX into which gray data is inputted.

When the α value and the β value are determined as described above, the α value is replaced with α' by a predetermined correction parameter β, and the replacement with α' may be performed according to Equation 2.

The replaced α' value is used to convert the lookup table LUT by multiplying the value provided by the lookup table by the α' value.

Based on the data of the converted lookup table as described above, the gray data D(n) is converted at step S122 to generate the final gray data D(n)'.

In the above description, the value of α' is a value changed so that the corrected final gray data D(n)' cancels a voltage variation variable of ±X3 in Table 1. As a result, the gate voltage Vg at an ending time of the C programming period is equal to the voltage (VELVDD−Vth+K(VD(n)−VREF)) denoted in FIG. 4.

Hereinafter, a case in which α is smaller than 0 in FIG. 7 will be described.

When the α value is smaller than 0, since the β value used when the α value is larger than 0 may not be used, the lookup table LUT is converted by using the β' value, which is another correction parameter (S32). The gray data D(n) is converted based on the converted lookup table at step S132 to generate final gray data D(n)'.

The β' value is determined according to the α value and is a correction parameter, and it adjusts a degree of correction of the lookup table LUT according to a size of the α value. Various β' values according to the α value may be stored in a memory of the display device. The β' value may be stored based on a weight or by considering all gray data values of each pixel PX into which gray data is inputted.

When the α value and the β' value are determined as described above, the α value is replaced with α" by a predetermined correction parameter β', and the replacement with α" may be performed according to Equation 3.

The replaced α" value is used to convert the lookup table LUT by multiplying the value provided by the lookup table by the α" value.

Based on the data of the converted lookup table as described above, the gray data D(n) is converted at step S132 to generate the final gray data D(n)'.

In the above description, the value of α" is a value changed so that the corrected final gray data D(n)' cancels a voltage variation variable of ±X3 in Table 1. As a result, the gate voltage Vg at an ending time of the C programming period is equal to the voltage (VELVDD−Vth+K(VD(n)−VREF)) denoted in FIG. 4.

FIG. 7 also shows a case in which the value of α is zero. In this case, the α value is converted to 1 and the β value is also used as 1 at step S42 so that the existing lookup table LUT is not changed. That is, when the value of α is 0, the value of α is converted to 1 and the value of β is also used as 1 at step S42, so that the lookup table LUT is not converted. Since the gray data D(n) is converted based on the unconverted lookup table (S143), the final gray data D(n)' may be substantially the same as the original gray data D(n).

Although it is illustrated in FIG. 7 that the lookup table is not changed only when the value of α is 0, in embodiments, the lookup table may not be changed when the value of α is less than or equal to a predetermined level (for example, −1 or more to 1 or less).

The methods as described above with reference to FIG. 5 to FIG. 7 may be integrated and summarized as follows.

The absolute change amount (|α|) according to the difference between the n-th gray data and the (n−1)-th gray data among the gray data outputted along one data line is calculated.

With respect to the calculated absolute change amount (|α|), the characteristics of the display part 600 and a plurality of optimized correction parameters (β and β') for each display device used are stored.

A suitable one of the stored correction parameters (β and β') is selected based on the calculated absolute change amount (|α|).

Then, the α value is replaced by the value of α' or α" according to the selected correction parameter (β or β').

The lookup table LUT is converted based on the replaced values α' and α", and in the present embodiment, the conversion is done by multiplying the replaced values α' and α" with values of the lookup table.

The output value of the n-th gray data is changed by using the converted final lookup table LUT. The changed n-th gray data has gray data values that may compensate for leakage characteristics of the transistors in the pixel PX.

In the above, the lookup table is not changed when there is no difference between the n-th gray data and the (n−1)-th gray data is described, may also not be changed even if the difference is equal to or greater than a predetermined level.

In the embodiments of FIG. 5 to FIG. 7 described above, the final gray data is converted by converting a previously stored lookup table LUT.

However, in embodiments, different lookup tables LUT may be stored according to the α value and/or β and β' values, and the final gray level data D(n−2)' may be generated based on the different lookup tables LUT.

In the embodiments described above, the lookup table may include a first lookup table (also referred to as a lookup table for threshold voltage compensation) for compensating the characteristics of the driving transistor (T1 of FIG. 2) and a second lookup table (also referred to as a lookup table for leakage current compensation) that compensates for the leakage current of the second transistor T2 that transmits the data voltage into the pixel PX.

In embodiments, the second lookup table may be set to compensate for characteristics of other elements included in the pixel PX.

In embodiments, the first lookup table and the second lookup table may be formed as only one lookup table. In this case, values stored in the one lookup table are values stored based on both pieces of information to be compensated in the first and second lookup tables.

Hereinafter, a structure of the image data converter 110 included in the signal controller 100 will be described with reference to FIG. 8.

Figure 8:
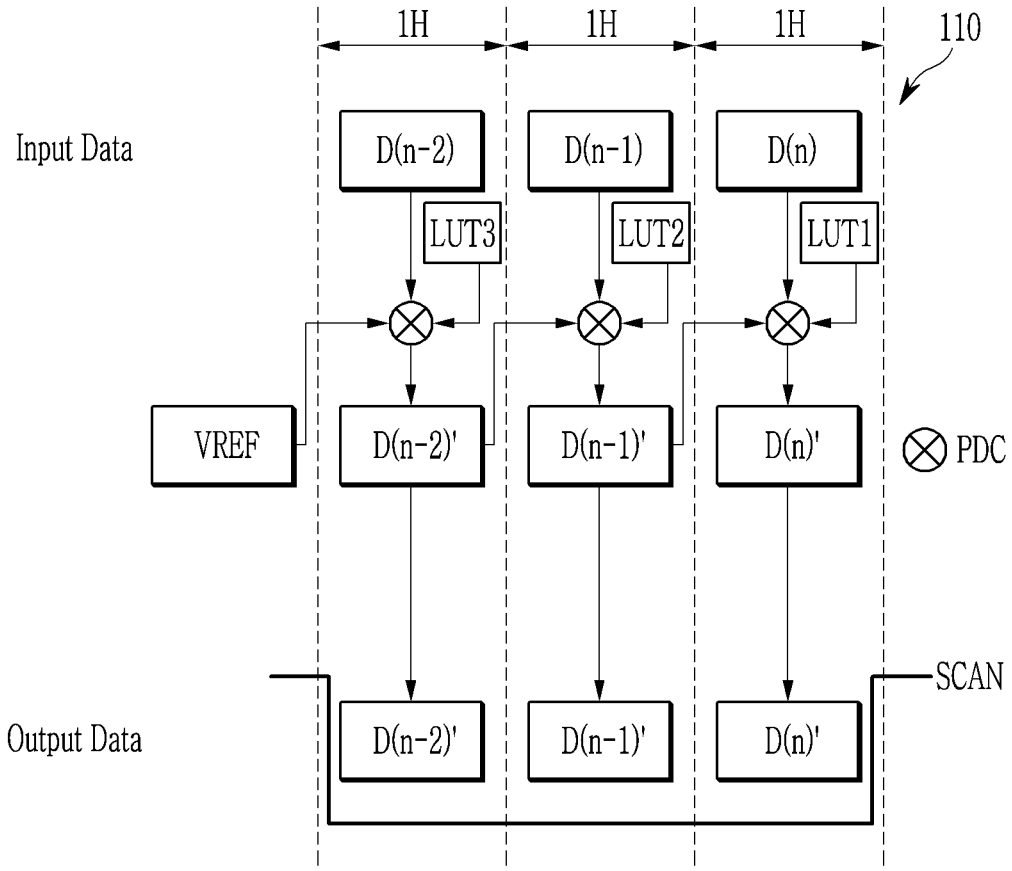
FIG. 8 illustrates a block diagram of an image data converter in a signal controller.

FIG. 8 illustrates a block diagram of an image data converter in a signal controller.

The image data converter 110 is formed in the signal controller 100, and the final gray data converted by the image data converter 110 is rearranged to be transmitted to the data driver 300.

The image data converter 110 includes a memory such as a line memory that stores gray data. In FIG. 8, square boxes surrounding the gray data (D(n−2), D(n−1), D(n), D(n−2)', D(n−1)', and D(n)') schematically show memories that store respective gray scale data. In addition, the value of the reference voltage VREF is also stored in the memory.

Referring to FIG. 8, three gray data (D(n−2), D(n−1), D(n)) to be programmed (written) to one pixel PX during a programming period are sequentially allocated and stored in the memory.

Respective stored gray data are sequentially PDC-processed from D(n−2).

First, the gray data D(n−2) is PDC-processed (see FIG. 5) by using the lookup table LUT3 and the reference voltage VREF to generate the final gray data D(n−2)' and store it in the memory. The final gray data D(n−2)' stored in the memory is gray data to be outputted to the data driver 300, and the gray data is used for the PDC-processing of the D(n−1).

The gray data D(n−1) is PDC-processed (as shown in FIG. 6) by using the final gray data D(n−2)' and the lookup table LUT2 to generate the final gray data D(n−1)' and store the final gray data D(n−1)' in the memory. The final gray data D(n−1)' stored in the memory is the gray data to be outputted to the data driver 300, and the gray data is used for the PDC-processing of the D(n).

The gray data D(n) is PDC-processed (as shown in FIG. 7) by using the final gray data D(n−1)' and the lookup table LUT1 to generate the final gray data D(n)' and store it in the memory. The final gray data D(n)' stored in the memory is gray data to be outputted to the data driver 300.

The plurality of final gray data (D(n−2)', D(n−1)', and D(n)') are rearranged together with other gray data, bundled into an image data signal DAT, and transmitted to the data driver 300.

In FIG. 8, an interval of 1H and a scan signal SCAN applied to the first scan line SLn are shown together so that a time that each PDC-operation is transmitted from the data driver 300 to the display part 600 may be known. This may be different from the time at which the PDC-operation is actually performed in the image data converter 110.

The three lookup tables LUT1, LUT2, and LUT3 illustrated in FIG. 8 may be used by changing the lookup tables shown in FIG. 5 to FIG. 7, and they may respectively store different lookup tables in memories.

That is, based on a difference between the reference voltage VREF and the voltage of the inputted gray data D(n−2), gray data D(n−2) may be changed to the optimized gray data D(n−2)' by using the LUT3, which is an optimized lookup table. In addition, based on a difference between the voltage of the gray data D(n−2) and the voltage of the inputted gray data D(n−1), gray data D(n−1) may be changed to the final gray data D(n−1)' by using LUT2, which is an optimized lookup table. Based on a difference between the voltage of the gray data D(n−1) and the voltage of the inputted gray data D(n), D(n) may be changed to the final gray data D(n)' by using LUT1, which is an optimized lookup table.

Referring to FIG. 4 through FIG. 8, when the leakage of the second transistor T2 of FIG. 4 is greater than or equal to a predetermined level, gray data may need to be corrected to final gray data through compensation based on consideration of the leakage, as in FIG. 5 to FIG. 8. However, although the PDC-correction may be performed in all of the programming periods, the PDC-correction may be performed only in some of the programming periods.

As such, an embodiment in which the PDC-correction may be selectively applied only in some of the programming periods is illustrated in FIG. 9.

FIG. 9 shows a table illustrating whether an image data converter is operated according to various embodiments.

The table of FIG. 9 shows that the PDC-correction can be selectively applied to some of the A programming period, the B programming period, and the C programming period.

Even if the final gray data is generated by the PDC-correction in the A programming period, when a luminance difference displayed by the light emitting diode LED is small in an actual light emitting period, the PDC-correction may not be applied in the A programming period. The third row from the bottom of FIG. 9 illustrates this circumstance.

As such, even if the PDC-correction is not performed, the PDC-correction may not be performed when a change in the luminance displayed by the light emitting diode LED is not recognized.

Figure 10:
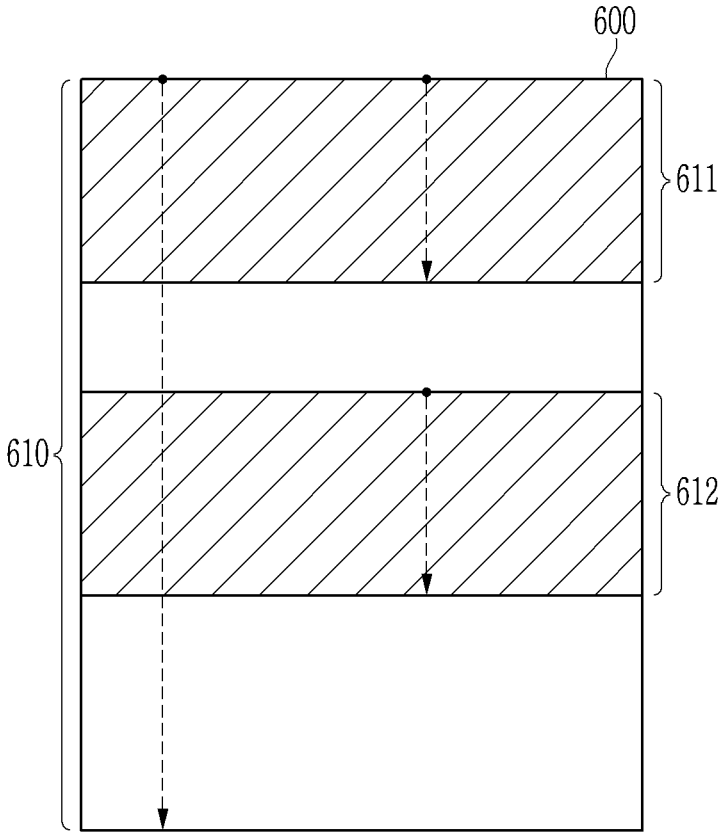
FIG. 10 illustrates a schematic view of a region for converting image data in display devices according to various embodiments.

In some embodiments, the PDC-correction may not be performed in all the pixels PX included in the display part 600, but the PDC-correction may be performed in only some of the pixels PX, which is illustrated in FIG. 10.

FIG. 10 illustrates a schematic view of a region for converting image data in display devices according to various embodiments.

In FIG. 10, rows for performing the PDC-correction in the display part 600 according to the embodiment are indicated by reference numerals 610, 611, and 612, respectively.

That is, an embodiment corresponding to the reference numeral 610 is a case in which the PDC-correction is performed for the pixels PX of all the rows included in the display part 600. In this case, as shown in FIG. 9, the PDC-correction may be performed only in a partial programming period.

Embodiments corresponding to reference numerals 611 and 612 are cases in which PDC-correction is performed for the pixel PX included in some of the rows of the display part 600. An embodiment of the reference numeral 611 is a case in which the PDC-correction is performed only from a first row to a predetermined number of pixel rows, and an embodiment of reference numeral 612 is a case in which the PDC-correction is performed only from a middle pixel row to a predetermined number of pixel rows. In this case, as shown in FIG. 9, the PDC-correction may be performed only in a partial programming period.

As described above, the PDC-correction may not performed because the luminance of the displayed light emitting diode LED is not changed even though a specific PDC-correction is not performed in the corresponding pixel PX.

When the embodiment of the FIG. 9 and FIG. 10 is enlarged, even when a corresponding pixel row is selected to be PDC-corrected, an embodiment in which some of the pixels PX included in the pixel row are not PDC-corrected is possible. This is because the PDC-correction may be selectively performed, so that all the PDC-corrections may be excluded for the specific pixel PX.

Figure 12:
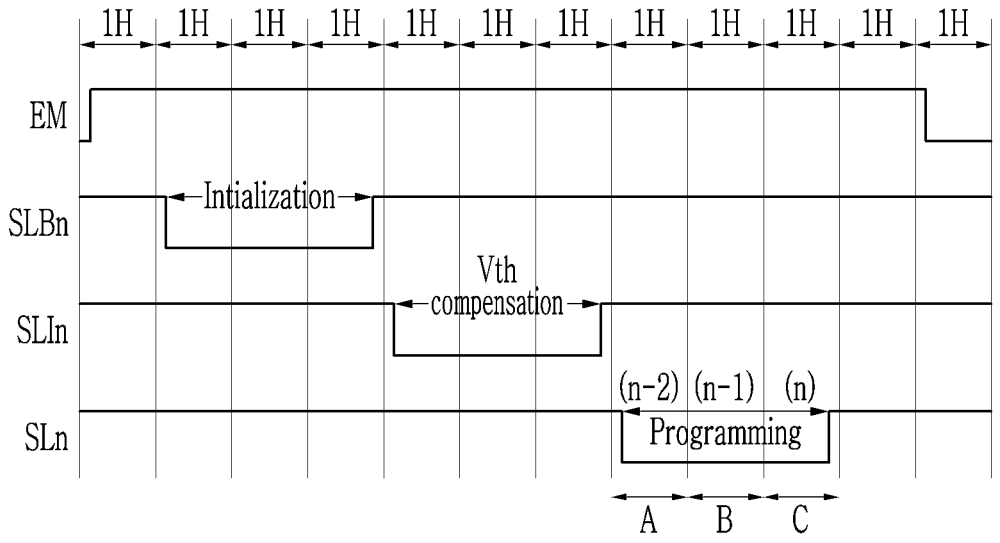
FIG. 12 illustrates a waveform diagram of a signal applied to the pixel of FIG. 11.

FIG. 11 illustrates an equivalent circuit diagram of one pixel of an organic light emitting diode display device according to an embodiment, and FIG. 12 illustrates a waveform diagram of a signal applied to the pixel of FIG. 11.

In the embodiment of FIG. 11, the scan line connected to the gate electrode of the seventh transistor T7 is not the fourth scan line SLBn+1 but is the third scan line SLBn. Since the third scan line SLBn is the scan line connected to the gate electrode of the fourth transistor T4, the fourth transistor T4 and the seventh transistor T7 receive the same scan signal.

Accordingly, in FIG. 12, a waveform applied to the fourth scan line SLBn+1 is eliminated.

In the pixel PX, the timing of initializing the anode of the light emitting diode LED by the seventh transistor T7 to the initialization voltage Vint is the same as that of initializing the gate electrode of the driving transistor T1 by the fourth transistor T4 to the initialization voltage Vint.

The remaining other operations are the same as those of FIG. 11 and FIG. 3, and all of the embodiments of FIG. 4 to FIG. 10 may be applied to the pixel PX according to the embodiment of FIG. 11 and FIG. 12.

Meanwhile, in the waveform diagrams of FIG. 3 and FIG. 12, the gate-on voltages applied to the first scan line SLn, the second scan line SLIn, the third scan line SLBn may overlap each other.

Figure 13:
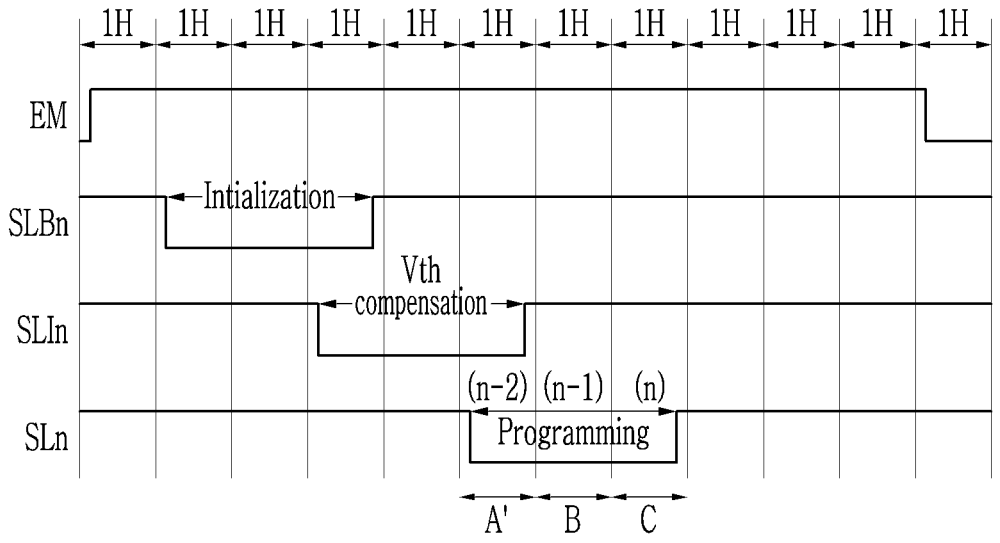
FIG. 13 illustrates a waveform diagram of a signal applied to the pixel of FIG. 2 or FIG. 11.

To illustrate this, an embodiment having periods overlapping each other as shown in FIG. 13 in the structure of the pixel PX of FIG. 11 will be described.

FIG. 13 illustrates a waveform diagram of a signal applied to the pixel of FIG. 2 or FIG. 11.

In the embodiment of FIG. 13, the initialization period and the Vth compensation period overlap each other for about 1H, and the Vth compensation period and the programming period overlap each other for 1H.

The overlapping portions of respective periods will now be described.

First, an operation of the pixel PX in a period in which the initialization period and the Vth compensation period overlap is as follows.

While the initialization period and the Vth compensation period overlap each other in the pixel PX of FIG. 11, the first and second electrodes of the second capacitor C2 are respectively fixed to the initialization voltage Vint and the reference voltage VREF. Accordingly, an operation in the Vth compensation period does not generally proceed, wherein the operation corresponds to an operation in which, as the reference voltage VREF is applied to the second electrode of the second capacitor C2, the voltage of the first electrode of the second capacitor C2 is changed according to Equation 1, and thus the driving transistor T1 generates an output current and it is changed to VELVDD−Vth in which the threshold voltage Vth is reflected while being transmitted to the first electrode of the second capacitor C2 after passing through the third transistor T3. The initialization voltage Vint becomes the voltage of the first electrode of the second capacitor C2.

As described above, although the Vth compensation operation is not performed, as shown in FIG. 13, since there is the Vth compensation period that does not overlap the initialization period, the Vth compensation operation is performed. That is, since the Vth compensation period does not overlap another period for 1H or more, the Vth compensation operation is performed during the corresponding period, so that there is no problem in display quality in the pixel PX.

Meanwhile, an operation of the pixel PX in the period in which the Vth compensation period and the programming period overlap each other will be described with reference to FIG. 14.

FIG. 14 illustrates a table summarizing a voltage change in each programming period in the embodiment of FIG. 13.

In FIG. 14, a period of the programming period overlapping the Vth compensation period is denoted as an A' programming period.

In the A' programming period, the data voltage VD(n−2) is applied from the data line to be transmitted to the second electrode of the second capacitor C2, but since the reference voltage VREF is applied to the second electrode of the second capacitor C2, the voltage VREF may be maintained. As a result, the voltage of the second electrode of the second capacitor C2 is not changed, and thus, it would be difficult to see that the data voltage is written.

However, during the B and C programming periods, the data voltages VD(n−1) and VD(n) are applied, and the PDC compensation denoted in FIG. 6 to FIG. 8 may be applied, thus the light emitting diode LED may display accurate luminance during the light emitting period.

That is, referring to FIG. 14, a change value of the gate voltage Vg is different from that of FIG. 4 even in the B programming period. In FIG. 14, the change value of the gate voltage Vg is K(VD(n−1)−VREF), which is different from K(VD(n−1)−VD(n−2)) which is the gate voltage Vg in FIG. 4. However, it can be seen that the gate voltages Vg in the programming periods B in FIG. 4 and FIG. 14 are VELVDD−Vth+K(VD(n−1)−VREF) as the same voltage.

Therefore, since the gate voltage Vg in the B programming period has the same voltage as that of the embodiment (FIG. 3, etc.) having the A programming period which does not overlap even though the overlapped programming period A' exists as in the embodiment of FIG. 13, the light emitting diodes LED may display the same luminance. Thus there is no problem in display quality.

Both the PDC compensation described in FIG. 6 to FIG. 8 and the PDC compensation according to the embodiments described in FIG. 9 and FIG. 10 may also be applied to the embodiment of FIG. 13.

In addition, the waveforms having the periods overlapping each other may be applied to the pixel PX of FIG. 2, and may have the same effect.

Hereinafter, another waveform applied to the pixel PX having the structure of FIG. 11 will be described with reference to FIG. 15 to FIG. 17.

Figure 15:
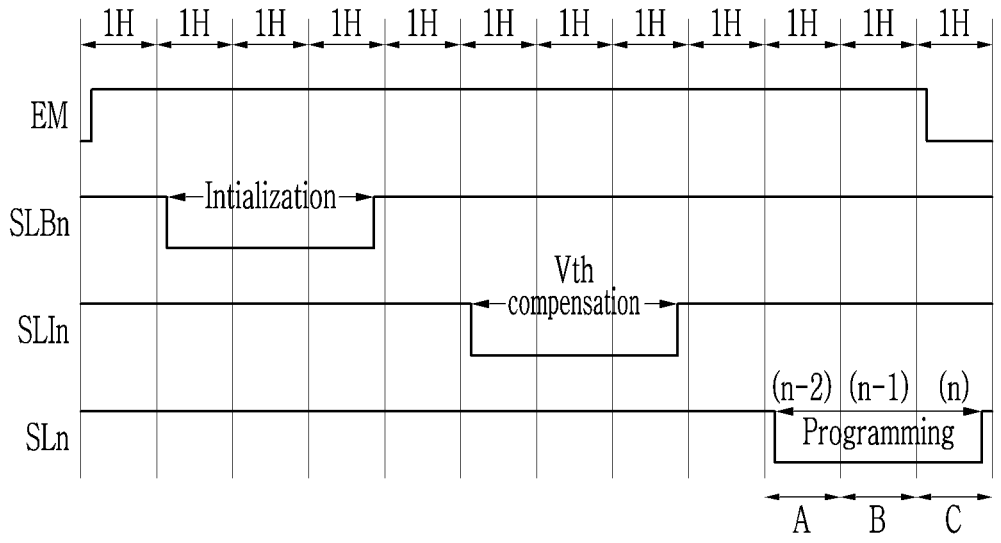
FIG. 15, FIG. 16, and FIG. 17 illustrate waveform diagrams of a signal applied to the pixel of FIG. 2 or FIG. 11.
Figure 16:
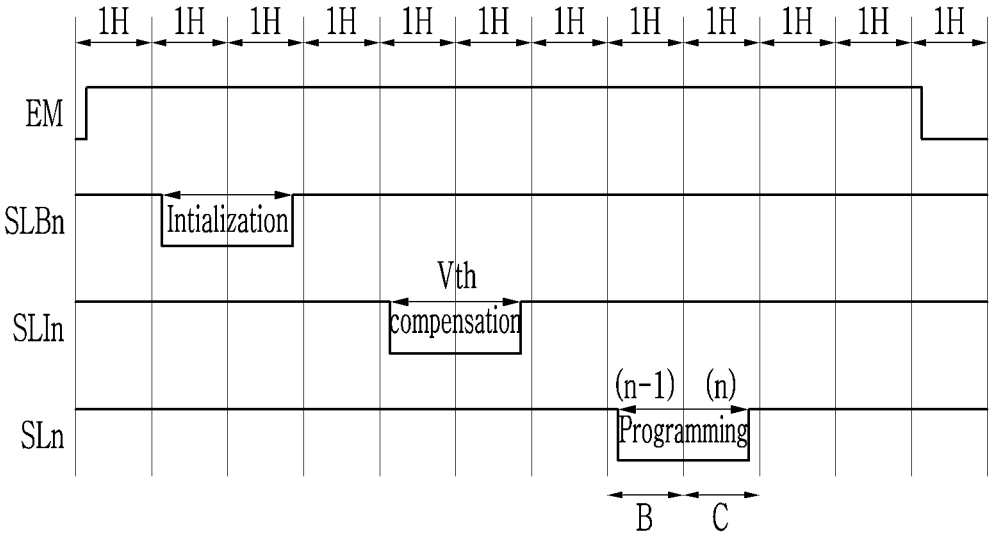
Figure 17:
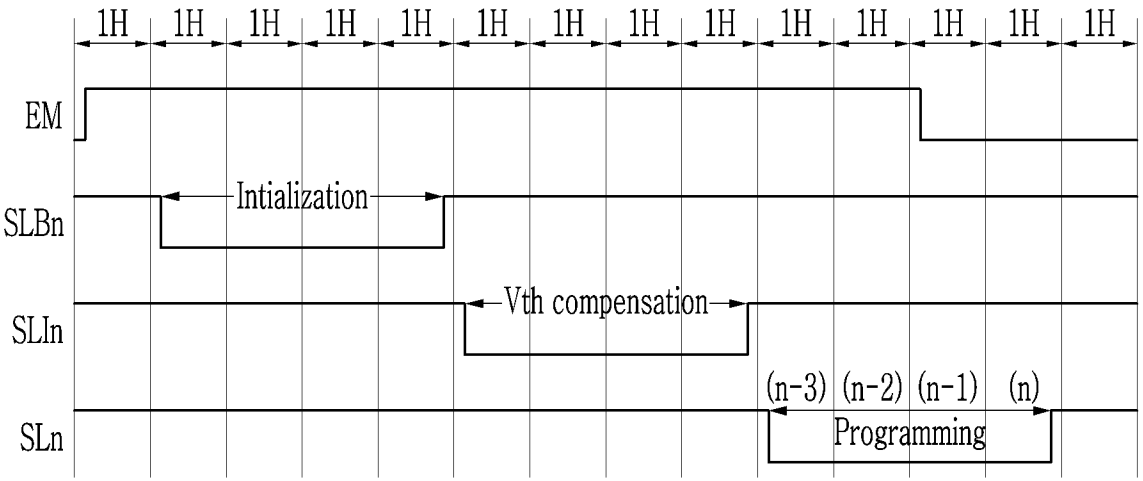

FIG. 15 to FIG. 17 illustrate waveform diagrams of a signal applied to the pixel of FIG. 2 or FIG. 11.

The waveform of FIG. 15 is spaced apart by about 1H between the periods. Accordingly, the initialization period, the Vth compensation period, and the programming period independently operate, and thus, they operate the same as in FIG. 2 and FIG. 11.

In addition, as shown in the waveform of FIG. 16, one period may not continue for 3H and may only continue for 2H. In this case, the initialization, Vth compensation, and programming (writing) operations must all be able to be completed in a 2H time.

Meanwhile, in embodiments, each period may continue for 4H as shown in FIG. 17. In this case, the initialization, Vth compensation, and programming operations may be insufficient even by 3H alone for high speed driving or high resolution display. A time that one period may have should be 1H or more, and an upper limit of the period is not limited. However, since the time of one frame is shared, it actually has a finite time.

According to FIG. 3, FIG. 12, FIG. 13, FIG. 14, FIG. 15, FIG. 16 and FIG. 17, the rising edge and the falling edge of signals are slightly different from the line between adjacent 1Hs. The difference between the edges and the line between adjacent 1Hs may mean a margin not to cross the line between adjacent 1Hs.

In addition, in embodiments, some periods may be performed for 2H or 4H, and other periods may be performed for 3H. If the Vth compensation period needs the longest time, only the Vth compensation period may be lengthened and other periods may be shorter than the Vth compensation period.

Accordingly, various embodiments that may be modified may be realized.

The description for FIG. 15 to FIG. 17 described above may also be applied to the pixel PX of FIG. 2, and the same effect may be provided.

While this disclosure has been described in connection with what is presently considered to be practical example embodiments, it is to be understood that the present inventive concept is not limited to the disclosed embodiments, but, on the contrary, is intended to cover various modifications and equivalent arrangements included within the spirit and scope of the appended claims.

What is claimed is:

1. A display device comprising:

a light emitting diode;

a driving transistor configured to supply a current to the light emitting diode;

a switching transistor having an input electrode connected to a data line; and a voltage transmitting capacitor disposed between an output electrode of the switching transistor and a gate electrode of the driving transistor, wherein a data voltage applied to the data line is transmitted to the gate electrode of the driving transistor through the voltage transmitting capacitor, wherein the data voltage has a data voltage value from which a voltage variation variable is removed based on leakage of the switching transistor, wherein the data voltage is a compensated data voltage which has a data voltage value from which a voltage variation variable is removed based on leakage of the switching transistor, and wherein the compensated data voltage is a voltage that is compensated based on parasitic capacitance of a first electrode among two electrodes of the voltage transmitting capacitor, the first electrode connected to the gate electrode of the driving transistor.

2. The display device of claim 1, wherein the compensated data voltage is compensated based on a magnitude of the data voltage before and after being applied to one data line.

3. The display device of claim 2, wherein each of a plurality of pixels includes the light emitting diode, the driving transistor, the switching transistor, and the voltage transmitting capacitor, and the display device includes:

a display part in which the plurality of the pixels are formed and including a scan line and a data line;

a data driver connected to the data line;

a scan driver connected to the scan line; and a signal controller configured to control the data driver and the scan driver.

4. The display device of claim 3, wherein the signal controller includes a lookup table, and a value stored in the lookup table is stored in a location based on leakage of the switching transistor.

5. The display device of claim 4, wherein the plurality of pixels is configured to have an initialization period, a Vth compensation period, and a programming period, and the Vth compensation period and the programming period do not overlap.

6. The display device of claim 5, wherein the signal controller further includes an image data converter, and the image data converter is configured to generate a final gray data by using a continuous gray data inputted to the programming period and the lookup table in one pixel PX.

7. The display device of claim 1, wherein a second electrode, which is another electrode among the two electrodes of the voltage transmitting capacitor, is connected to the switching transistor through a first node, and the first node is configured to have a reference voltage before the switching transistor is turned on.

8. The display device of claim 7, wherein the compensated data voltage is applied so that a voltage of the gate electrode of the driving transistor is VELVDD−Vth+K(VD(n)−VREF), where VELVDD is a voltage value of a first power supply voltage, Vth is a threshold voltage value of the driving transistor, K is [C2/(C2+Cp)], C2 is a capacitance of the voltage transmitting capacitor, Cp is a parasitic capacitance that is parasitic next to the first electrode of the voltage transmitting capacitor, VD(n) is a voltage value of D(n) that is currently applied gray data, and VREF is a reference voltage value.

9. The display device of claim 8, wherein an input electrode of the driving transistor is connected to the first power supply voltage, and wherein a hold capacitor is disposed between the first power supply voltage and the first node.

10. The display device of claim 9, further comprising a compensation transistor having an input electrode connected to an output electrode of the driving transistor and an output electrode connected to the first node.

11. The display device of claim 10, further comprising a current transmitting transistor having an output electrode connected to the light emitting diode and an input electrode connected to the output electrode of the driving transistor.

12. The display device of claim 11, further comprising a gate initialization transistor configured to initialize a voltage of the gate electrode of the driving transistor, and a first node initialization transistor configured to initialize a voltage of the first node to the reference voltage.

13. The display device of claim 12, further comprising an anode initialization transistor configured to initialize an anode electrode that is one electrode of the light emitting diode.

14. A driving method of a display device, wherein the display device includes a light emitting diode, a driving transistor, a switching transistor provided with an input electrode connected to a data line, and a first capacitor disposed between an output electrode of the switching transistor and a gate electrode of the driving transistor, comprising:

obtaining a value of α that is a difference between an adjacent previous data voltage and a current data voltage to be applied to one data line;

determining a lookup table capable of removing a voltage variation variable due to leakage of the switching transistor based on the obtained a value; and changing gray data corresponding to the current data voltage based on the lookup table to generate a final gray data.

15. The driving method of the display device of claim 14, wherein the final gray data is compensated based on parasitic capacitance of a first electrode of the first capacitor connected to the gate electrode of the driving transistor.

16. The driving method of the display device of claim 14, wherein the determining of the lookup table includes:

determining whether a voltage is changed in a positive direction or in a negative direction or is not changed based on the value of α; and changing the lookup table except when the value of α is zero.

17. The driving method of the display device of claim 16, wherein the changing of the lookup table includes:

determining a correction parameter based on the value of α;

replacing the value of α based on the correction parameter; and converting a value replaced from the value of α by multiplying it by the value stored in the lookup table.

18. The driving method of the display device of claim 17, wherein the correction parameter is a value determined based on the value of α or determined based on a weight.

19. The driving method of the display device of claim 18, wherein a voltage of the gate electrode of the driving transistor by the final gray data is VELVDD−Vth+K(VD(n)−VREF), wherein VELVDD is a voltage value of a first driving voltage, Vth is a threshold voltage value of the driving transistor, K is [C2/(C2+Cp)], C2 is a capacitance of the first capacitor, Cp is a parasitic capacitance that is parasitic next to a first electrode of the first capacitor, VD(n) is a voltage value of D(n) which is currently applied gray data, and VREF is a voltage of a first node at which the first capacitor and the switching transistor are connected before the switching transistor is turned on.

* * * * *